US007006119B2

(12) United States Patent
Takesue

(10) Patent No.: US 7,006,119 B2
(45) **Date of Patent: *Feb. 28, 2006**

(54) IMAGE FORMING APPARATUS WITH PHOTOCONDUCTIVE BODY, AND COMPUTER-READABLE STORAGE MEDIUM

(75) Inventor: Toshihiro Takesue, Tokyo (JP)

(73) Assignees: Ricoh Company, Ltd., Tokyo (JP); Ricoh Corporation, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/951,629

(22) Filed: Sep. 29, 2004

(65) Prior Publication Data

US 2005/0093969 A1 May 5, 2005

Related U.S. Application Data

(63) Continuation of application No. 10/663,885, filed on Sep. 17, 2003, now Pat. No. 6,839,074, which is a continuation of application No. 09/985,666, filed on Nov. 5, 2001, now Pat. No. 6,654,041.

(30) Foreign Application Priority Data

Nov. 6, 2000 (JP) ..... 2000-337941

(51) Int. Cl.
*B41J 2/47* (2006.01)

(52) U.S. Cl. ..... 347/240; 347/251

(58) Field of Classification Search ..... 347/233–235, 347/248–254, 229, 240; 382/267, 275; 358/448, 358/409–412; 372/29.016
See application file for complete search history.

(56) References Cited

U.S. PATENT DOCUMENTS

| | | | | |
|---|---|---|---|---|
| 5,764,378 | A * | 6/1998 | Oda et al. | 358/448 |
| 5,831,658 | A | 11/1998 | Iga et al. | 347/171 |
| 5,838,465 | A | 11/1998 | Satou et al. | 358/520 |
| 6,082,911 | A | 7/2000 | Murakami | 400/74 |
| 6,198,549 | B1 | 3/2001 | Decker et al. | 358/504 |
| 6,654,041 | B1 | 11/2003 | Takesue | 347/234 |
| 6,839,074 | B1 * | 1/2005 | Takesue | 347/234 |

FOREIGN PATENT DOCUMENTS

| | | |
|---|---|---|
| JP | 56-104572 | 8/1981 |
| JP | 57-67375 | 4/1982 |
| JP | 61-137122 | 6/1986 |
| JP | 4-35453 | 2/1992 |
| JP | 11-170597 | 6/1999 |

* cited by examiner

*Primary Examiner*—Hai Pham
(74) *Attorney, Agent, or Firm*—Dickstein Shapiro Morin & Oshinsky LLP

(57) ABSTRACT

An image forming apparatus forms on a photoconductive body an evaluation chart including first patterns and second patterns. In the first pattern, with respect to a row of dots formed in a main scan direction by a predetermined light beam, a row of dots formed by a next light beam is shifted in the main scan direction, and in the second pattern, with respect to the row of dots formed in the main scan direction by the predetermined light beam, the row of dots formed by the next light beam is shifted in the main scan direction but in a direction opposite to a shift direction of the first pattern. The evaluation chart includes a first pattern group which is formed by the first patterns which are repeated, and a second pattern group which is formed by the second patterns which are repeated.

7 Claims, 28 Drawing Sheets

FIG.12A
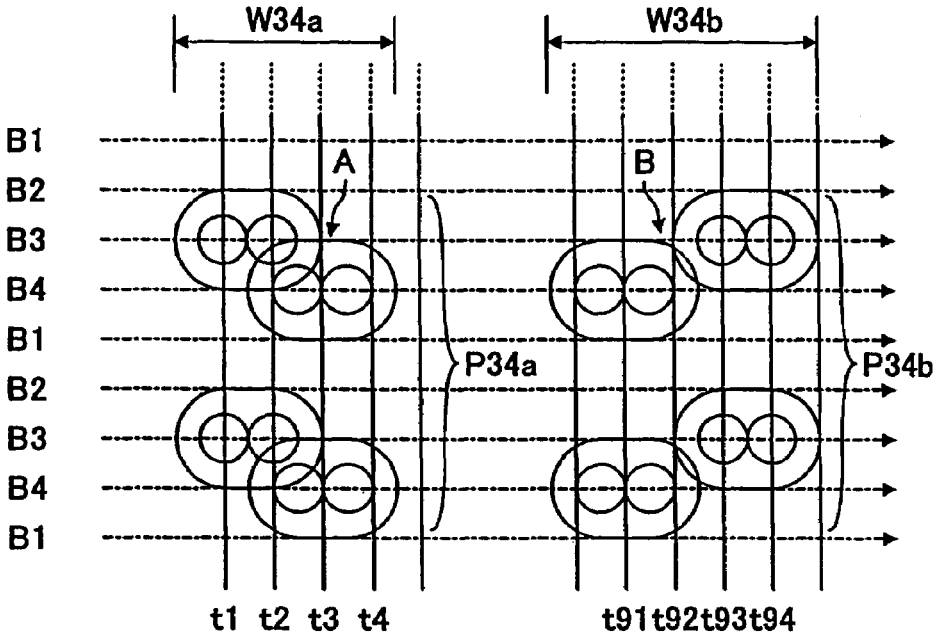
FIG.12B
FIG.13A
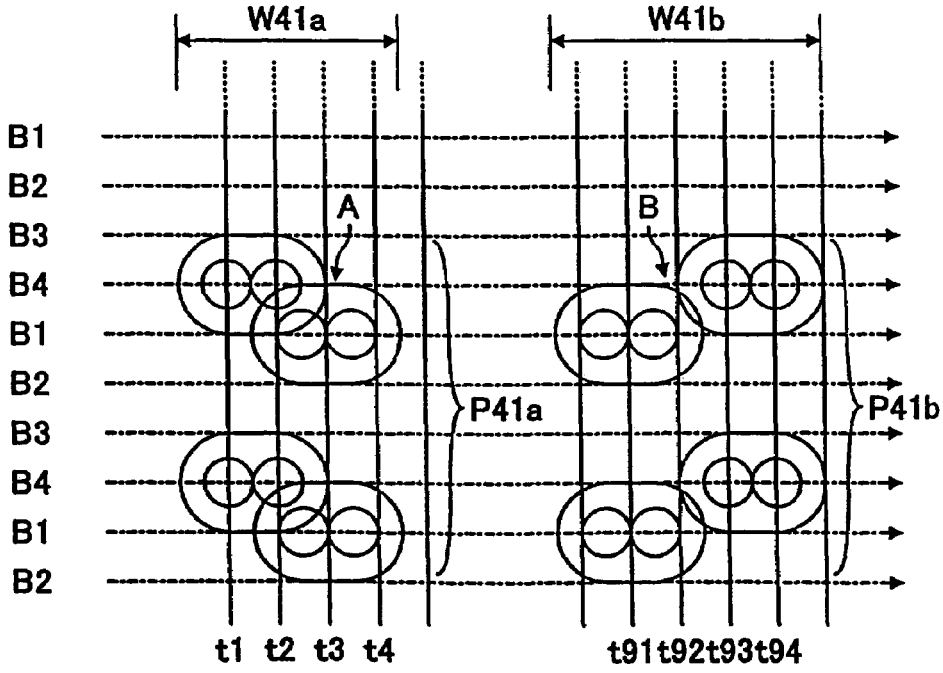
FIG.13B

IMAGE FORMING APPARATUS WITH PHOTOCONDUCTIVE BODY, AND COMPUTER-READABLE STORAGE MEDIUM

This application is a continuation of application Ser. No. 10/663,885 filed Sep. 17, 2003 (U.S. Pat. No. 6,839,074), which is a continuation of application Ser. No. 09/985,666, filed Nov. 5, 2001 (U.S. Pat. No. 6,654,041), the entire disclosures of which are hereby incorporated by reference.

BACKGROUND OF THE INVENTION

This application claims the benefit of a Japanese Patent Application No.2000-337941 filed Nov. 6, 2000, in the Japanese Patent Office, the disclosure of which is hereby incorporated by reference.

1. Field of the Invention

The present invention generally relates to image forming apparatuses and storage media, and more particularly to an image forming apparatus typified by a laser printer and a digital copying machine, and to a computer-readable storage medium which stores a program for causing a computer to carry out an operation of outputting an evaluation chart (or test pattern) and/or automatically correcting a phase error between a plurality of light beams.

2. Description of the Related Art

Conventionally, there are image recording apparatuses (image forming apparatuses) which employ a multi-beam system to record images at a high speed. According to the multi-beam system, the images are recorded by scanning a photoconductive body by a plurality of light beams.

In the image recording apparatus employing the multi-beam system, it is necessary to control write timings of each of the light beams at which the images are written on the photoconductive body, so that write start positions of each of the light beams on the photoconductive body accurately match.

For example, a Japanese Laid-Open Patent Application No.56-104572 proposes a beam recording apparatus which records information on a recording medium by scanning the recording medium by a plurality of light beams. A beam detector is provided outside an effective scan region of the plurality of light beams, and a selected one of the plurality of light beams is controlled so that this selected light beam passes the beam detector in an ON state. A plurality of electrical modulating signals are generated to modulate the plurality of light beams, based on an output of the beam detector. The modulating signals are delayed and controlled depending on the arrangements of the plurality of light beams, so that recording start positions of the plurality of light beams match on the recording medium.

In addition, a Japanese Laid-Open Patent Application No.57-67375 proposes a multi-beam recording apparatus which records information on a recording medium by scanning the recording medium by a plurality of light beams. A beam detector outputs a detection signal when arrivals of the plurality of beams to predetermined positions are detected. A beam selector is provided to select one of the plurality of light beams to be supplied to the beam detector. A distributor distributes the detection signal so that recording start timings of the plurality of light beams are controlled depending on the distributed detection signal.

Moreover, a Japanese Laid-Open Patent Application No.61-137122 proposes a laser beam printer which uses a plurality of scanning laser beams. The plurality of laser beams are arranged so as not to overlap on a photodetector, and detection signals are time-divisionally and independently detected from each of the laser beams. Signal write timings are controlled depending on a correspondence of the detection signals and the laser beams.

Furthermore, a Japanese Laid-Open Patent Application No.4-35453 proposes an image forming apparatus including a plurality of light sources, a photoconductive body which is irradiated by a plurality of parallel light beams emitted from the light sources and deflected to scan the photoconductive body, light sensors disposed outside a light scan region on a main scan start side of the photoconductive body, and a pixel clock generating circuit for generating a pixel clock synchronized to synchronization detection signals which are generated by detecting the light beams by the light sensors. The number of light sensors is equal to the number of light sources. In addition, the light sources and the light sensors are respectively arranged at predetermined angles to a surface which is scanned by the light beams. The light sensors detect the corresponding light beams, so as to generate the synchronization detection signals.

The beam recording apparatus proposed in the Japanese Laid-Open Patent Application No.56-104572 is applied to cases such as when a semiconductor laser array is used as the light source and the distance between two light beams in the main scan direction on the photoconductive body, that is, the recording medium, is known. Only one specific light beam is detected by the beam detector, and the modulation signal for modulating this one specific light beam is generated based on the output of the beam detector. The output of the beam detector is delayed by a time corresponding to the distance between the two light beams, so as to generate a modulating signal for modulating another light beam. The write timings of all of the light beams are controlled in this manner.

For this reason, each light emitting position of the semiconductor laser array is positioned extremely accurately during the production process of the beam recording apparatus. However, due to inconsistencies introduced by processing errors and assembling errors of optical parts from the light source to the photoconductive body, a slight error is introduced in the optical magnification from the light source to the photoconductive body, and it is difficult to accurately match the write positions of the plurality of light beams.

On the other hand, in the multi-beam recording apparatus proposed in the Japanese Laid-Open Patent Application No.57-67375, the laser beam printer proposed in the Japanese Laid-Open Patent Application No.61-137122 and the image forming apparatus proposed in the Japanese Laid-Open Patent Application No.4-35453, a synchronization detection signal is obtained independently for each light beam, so that it is possible to more accurately control the phase of each of the light beams. In addition, even in a case where a plurality of semiconductor lasers, including laser diodes, are used as the light source, it is possible to control the write timings of each of the light beams relatively accurately.

But normally, in the multi-beam system image recording apparatus, when the semiconductor laser is used as the light source, each of the light beams are in many cases set so as to have predetermined intervals in the main scan direction in order to obtain predetermined beam intervals in the sub scan direction. Further, when a plurality of semiconductor lasers are used as the light source, each of the light beams are in many cases set so as to have predetermined intervals in the main scan direction so that the plurality of light beams independently reach the photodetector without overlap.

In addition, if a light intensity distribution of the light beam is inconsistent, it is impossible to obtain an accurate phase synchronizing signal. Moreover, if a difference exists in the wavelengths of the light beams, a magnification error is generated due to chromatic aberration of a scanning optical system which is formed by a fθ lens and the like.

In such cases, even if an accurate synchronization detection signal is obtained, a phase error, that is, a phase synchronization error, is generated among the light beams due to the magnification error. This phase error becomes larger towards a horizontal scanning end portion from a horizontal scanning start portion.

Furthermore, in the multi-beam system image recording apparatus (image forming apparatus), it is necessary to control the mount of light for each of the light beams so that output images based on each of the light beams become uniform. Normally, the amount of light is controlled for each of the light beams, based on an output of a photodiode which is provided inside a package of the semiconductor laser and detects a rearward output of the semiconductor laser. However, when using the plurality of light beams, even if the amount of light of each light beam is controlled at the light source portion including the semiconductor laser, the amount of light at the time of the exposure on the photoconductive body cannot necessarily be controlled to become uniform among each of the light beams because an optical path is different for each of the light beams. Moreover, if beam spot diameters at the time of the exposure on the photoconductive body are inconsistent, the images written by each of the light beams become inconsistent even if the amount of light are the same for each of the light beams.

In order to detect the inconsistencies of the images written by the plurality of light beams, a Japanese Laid-Open Patent Application No.11-170597 proposes an image forming apparatus which prints a dot test pattern.

However, the image forming apparatus proposed in the Japanese Laid-Open Patent Application No.11-170597 prints the dot test pattern by dots, such as 2×2 dots, having the same phase in the main scan direction. For this reason, although it is possible to detect a pitch error in the sub scan direction, there is a problem in that it is impossible to detect an error in the main scan direction.

SUMMARY OF THE INVENTION

Accordingly, it is a general object of the present invention to provide a novel and useful image forming apparatus and computer-readable storage medium, in which the problems described above are eliminated.

Another and more specific object of the present invention is to provide an image forming apparatus and a computer-readable storage medium which is capable of outputting an evaluation chart (or a test pattern) which may be used to simply detect with a high sensitivity a phase error of a plurality of light beams in a main scan direction in an image forming region.

Still another specific object of the present invention is to provide an image forming apparatus and a computer-readable storage medium which is capable of automatically detecting a phase error of a plurality of light beams and automatically correcting the phase error of the plurality of light beams.

A further object of the present invention is to provide an image forming apparatus comprising a light source portion emitting a plurality of light beams; a photoconductive body having an image forming surface; a deflecting unit deflecting the plurality of light beams from the light source portion to simultaneously scan the image forming surface of the photoconductive body; and a controller controlling the plurality of light beams to form an evaluation chart on the image forming surface of the photoconductive body, where the evaluation chart includes first patterns and second patterns, in the first pattern, with respect to a row of dots formed in a main scan direction by a predetermined light beam, a row of dots formed by a next light beam is shifted in the main scan direction, in the second pattern, with respect to the row of dots formed in the main scan direction by the predetermined light beam, the row of dots formed by the next light beam is shifted in the main scan direction but in a direction opposite to a shift direction of the first pattern, and the evaluation chart includes a first pattern group which is formed by the first patterns which are repeated in a sub scan direction with a period that is an integer multiple of a total number of the plurality of light beams and are also repeated in the main scan direction at predetermined intervals, and a second pattern group which is formed by the second patterns which are repeated in the sub scan direction with a period that is an integer multiple of the total number of light beams and are also repeated in the main scan direction at predetermined intervals. According to the image forming apparatus of the present invention, it is possible to simply detect with a high sensitivity a phase error of the plurality of light beams in the main scan direction within the image forming region, based on the evaluation chart.

The image forming apparatus may further comprise an output section printing the evaluation chart on the image forming surface of the photoconductive body onto a recording medium. In this case, the phase error can be visually detected from the evaluation chart printed on the recording medium.

In the image forming apparatus, the output section may print the evaluation chart such that, of the plurality of light beams B1, B2, . . . , Bm, where Bm≧2, the first and second pattern groups formed by the light beams B1 and B2, the first and second pattern groups formed by the light beams B2 and B3, . . . , the first and second pattern groups formed by the light beams B(m−1) and Bm, and the first and second pattern groups formed by the light beams Bm and B1 are printed on a single recording medium. In this case, it is possible to efficiently detect the phase error without being greatly affected by variation factors of the image forming apparatus.

In the image forming apparatus, corresponding first and second pattern groups may be arranged adjacent to each other on the evaluation chart. In this case, it is possible to efficiently detect the phase error without being greatly affected by variation factors of the image forming apparatus.

In the image forming apparatus, each first pattern group may have a corresponding second pattern group arranged adjacent thereto in both the main scan direction and the sub scan direction. In this case, it is possible to accurately detect the phase error of the light beams.

In the image forming apparatus, the controller may variably control a number of dots of the row of dots of each of the plurality of light beams when forming the evaluation chart. In this case, it is possible to simply detect the phase error of the light beams even if the apparatus or the resolution differs.

In the image forming apparatus, the controller may variably control a distance in the main scan direction between the row of dots formed by the predetermined light beam and the row of dots formed by the next light beam when forming the evaluation chart. In this case, it is possible to simply detect the phase error of the light beams even if the apparatus or the resolution differs.

In the image forming apparatus, the controller may variably control conditions related to forming the dots when forming the evaluation chart. In this case, it is possible to efficiently detect the phase error of the light beams without being greatly affected by the variation factors of the image forming apparatus.

In the image forming apparatus, the controller may control the plurality of light beams to form an evaluation chart having a pattern group of one of the plurality of light beams with a phase which is shifted in advance in the main scan direction, with respect to each of the first pattern group and the second pattern group. In this case, it is possible to simply detect the phase correcting amount corresponding to the phase error of the light beams, and thus efficiently detect the phase error of the light beams.

The image forming apparatus may further comprise phase correcting amount setting means for setting a phase correcting amount in the main scan direction. In this case, it is possible to simply detect the phase correcting amount corresponding to the phase error of the light beams, and thus efficiently detect the phase error of the light beams.

Another object of the present invention is to provide an image forming apparatus comprising a light source portion emitting a plurality of light beams; a photoconductive body having an image forming surface; a deflecting unit deflecting the plurality of light beams from the light source portion to simultaneously scan the image forming surface of the photoconductive body; and a controller controlling the plurality of light beams to form an evaluation chart on the image forming surface of the photoconductive body, where the evaluation chart includes first patterns and second patterns, in the first pattern, with respect to a row of dots formed in a main scan direction by a predetermined light beam, a row of dots formed by a next light beam is shifted in the main scan direction, in the second pattern, with respect to the row of dots formed in the main scan direction by the predetermined light beam, the row of dots formed by the next light beam is shifted in the main scan direction but in a direction opposite to a shift direction of the first pattern, and the evaluation chart includes a first pattern group which is formed by the first patterns which are repeated in a sub scan direction with a period that is an integer multiple of a total number of the plurality of light beams, and a second pattern group which is formed by the second patterns which are repeated in the sub scan direction with a period that is an integer multiple of the total number of light beams. According to the image forming apparatus of the present invention, it is possible to simply detect with a high accuracy the phase error of the plurality of light beams in the main scan direction within the image forming region.

The image forming apparatus may further comprise an output section printing the evaluation chart on the image forming surface of the photoconductive body onto a recording medium. In this case, the phase error can be visually detected from the evaluation chart printed on the recording medium.

In the image forming apparatus, the first and second pattern groups arranged in the sub scan direction in the evaluation chart may be disposed in a scan start side of a scan range of the deflecting unit. In this case, it is possible to simply detect the phase error of the light beams without being greatly affected by variation factors such as a polygon mirror included in the deflecting unit.

In the image forming apparatus, the first and second pattern groups arranged in the sub scan direction in the evaluation chart may be disposed in approximately a central portion of a scan range of the deflecting unit. In this case, it is possible to simply detect the phase error of the light beams without being greatly affected by variation factors such as a distortion introduced by an optical system.

In the image forming apparatus, the controller may variably control a number of dots of the row of dots of each of the plurality of light beams when forming the evaluation chart. In this case, it is possible to simply detect the phase error of the light beams even if the apparatus or the resolution differs.

In the image forming apparatus, the controller may variably control a distance in the main scan direction between the row of dots formed by the predetermined light beam and the row of dots formed by the next light beam when forming the evaluation chart. In this case, it is possible to simply detect the phase error of the light beams even if the apparatus or the resolution differs.

In the image forming apparatus, the controller may variably control conditions related to forming the dots when forming the evaluation chart. In this case, it is possible to efficiently detect the phase error of the light beams without being greatly affected by the variation factors of the image forming apparatus.

In the image forming apparatus, the controller may control the plurality of light beams to form an evaluation chart having a pattern group of one of the plurality of light beams with a phase which is shifted in advance in the main scan direction, with respect to each of the first pattern group and the second pattern group. In this case, it is possible to simply detect the phase correcting amount corresponding to the phase error of the light beams, and thus efficiently detect the phase error of the light beams.

The image forming apparatus may further comprise phase correcting amount setting means for setting a phase correcting amount in the main scan direction. In this case, it is possible to simply detect the phase correcting amount corresponding to the phase error of the light beams, and thus efficiently detect the phase error of the light beams.

Still another object of the present invention is to provide an image forming apparatus comprising pattern group generating means for generating on an image forming surface of a photoconductive body an evaluation chart having a pattern group of one of a plurality of light beams with a phase which is shifted in advance in a main scan direction, with respect to each of a first pattern group and a second pattern group; tone measuring means for measuring a tone of the pattern group in the evaluation chart; and phase correcting amount setting means for setting a phase correcting amount in the main scan direction, based on the tone measured by the tone measuring means. According to the image forming apparatus of the present invention, it is possible to automatically detect the phase error of the light beams and obtain the phase correcting amount, without the need to output the evaluation chart on a recording medium such as paper.

The image forming apparatus may further comprise phase synchronizing signal generating means for generating phase synchronizing signals of the plurality of light beams, based on the phase correcting amount set by the phase correcting amount setting means. In this case, it is possible to automatically adjust the phase error of the light beams.

A further object of the present invention is to provide an image forming apparatus comprising a pattern group generator generating on an image forming surface of a photoconductive body an evaluation chart having a pattern group of one of a plurality of light beams with a phase which is shifted in advance in a main scan direction, with respect to each of a first pattern group and a second pattern group; a tone sensor measuring a tone of the pattern group in the evaluation chart; and a phase correcting amount setting circuit setting a phase correcting amount in the main scan direction, based on the tone measured by the tone sensor. According to the image forming apparatus of the present invention, it is possible to automatically detect the phase error of the light beams and obtain the phase correcting amount, without the need to output the evaluation chart on a recording medium such as paper.

A further object of the present invention is to provide a computer-readable storage medium which stores a program for causing a computer to carry out an imaging process comprising the procedures of causing the computer to deflect a plurality of light beams to simultaneously scan an image forming surface of a photoconductive body; and causing the computer to control the plurality of light beams to form an evaluation chart on the image forming surface of the photoconductive body, where the evaluation chart includes first patterns and second patterns, in the first pattern, with respect to a row of dots formed in a main scan direction by a predetermined light beam, a row of dots formed by a next light beam is shifted in the main scan direction, in the second pattern, with respect to the row of dots formed in the main scan direction by the predetermined light beam, the row of dots formed by the next light beam is shifted in the main scan direction but in a direction opposite to a shift direction of the first pattern, and the evaluation chart includes a first pattern group which is formed by the first patterns which are repeated in a sub scan direction with a period that is an integer multiple of a total number of the plurality of light beams and are also repeated in the main scan direction at predetermined intervals, and a second pattern group which is formed by the second patterns which are repeated in the sub scan direction with a period that is an integer multiple of the total number of light beams and are also repeated in the main scan direction at predetermined intervals. According to the computer-readable storage medium of the present invention, it is possible to simply detect with a high sensitivity a phase error of the plurality of light beams in the main scan direction within the image forming region, based on the evaluation chart.

Another object of the present invention is to provide a computer-readable storage medium which stores a program for causing a computer to carry out an imaging process comprising the procedures of causing the computer to deflect a plurality of light beams to simultaneously scan an image forming surface of a photoconductive body; and causing the computer to control the plurality of light beams to form an evaluation chart on the image forming surface of the photoconductive body, where the evaluation chart includes first patterns and second patterns, in the first pattern, with respect to a row of dots formed in a main scan direction by a predetermined light beam, a row of dots formed by a next light beam is shifted in the main scan direction, in the second pattern, with respect to the row of dots formed in the main scan direction by the predetermined light beam, the row of dots formed by the next light beam is shifted in the main scan direction but in a direction opposite to a shift direction of the first pattern, and the evaluation chart includes a first pattern group which is formed by the first patterns which are repeated in a sub scan direction with a period that is an integer multiple of a total number of the plurality of light beams, and a second pattern group which is formed by the second patterns which are repeated in the sub scan direction with a period that is an integer multiple of the total number of light beams. According to the computer-readable storage medium of the present invention, it is possible to simply detect with a high sensitivity a phase error of the plurality of light beams in the main scan direction within the image forming region, based on the evaluation chart.

Still another object of the present invention is to provide a computer-readable storage medium which stores a program for causing a computer to carry out an imaging pro cess comprising the procedures of causing the computer to generate on an image forming surface of a photoconductive body an evaluation chart having a pattern group of one of a plurality of light beams with a phase which is shifted in advance in a main scan direction, with respect to each of a first pattern group and a second pattern group; causing the computer to measure a tone of the pattern group in the evaluation chart; and causing the computer to set a phase correcting amount in the main scan direction, based on the measured tone. According to the computer-readable storage medium of the present invention, it is possible to automatically detect the phase error of the light beams and obtain the phase correcting amount, without the need to output the evaluation chart on a recording medium such as paper.

Other objects and further features of the present invention will be apparent from the following detailed description when read in conjunction with the accompanying drawings.

BRIEF DESCRIPTION OF THE DRAWINGS

FIGS. 12A and 12B are diagrams for explaining the phase error of the light beams in the main scan direction;

FIGS. 13A and 13B are diagrams for explaining the phase error of the light beams in the main scan direction;

DESCRIPTION OF THE PREFERRED EMBODIMENTS

Various embodiments of an image forming apparatus according to the present invention and a computer-readable storage medium according to the present invention, will now be described with reference to the drawings.

Figure 1:
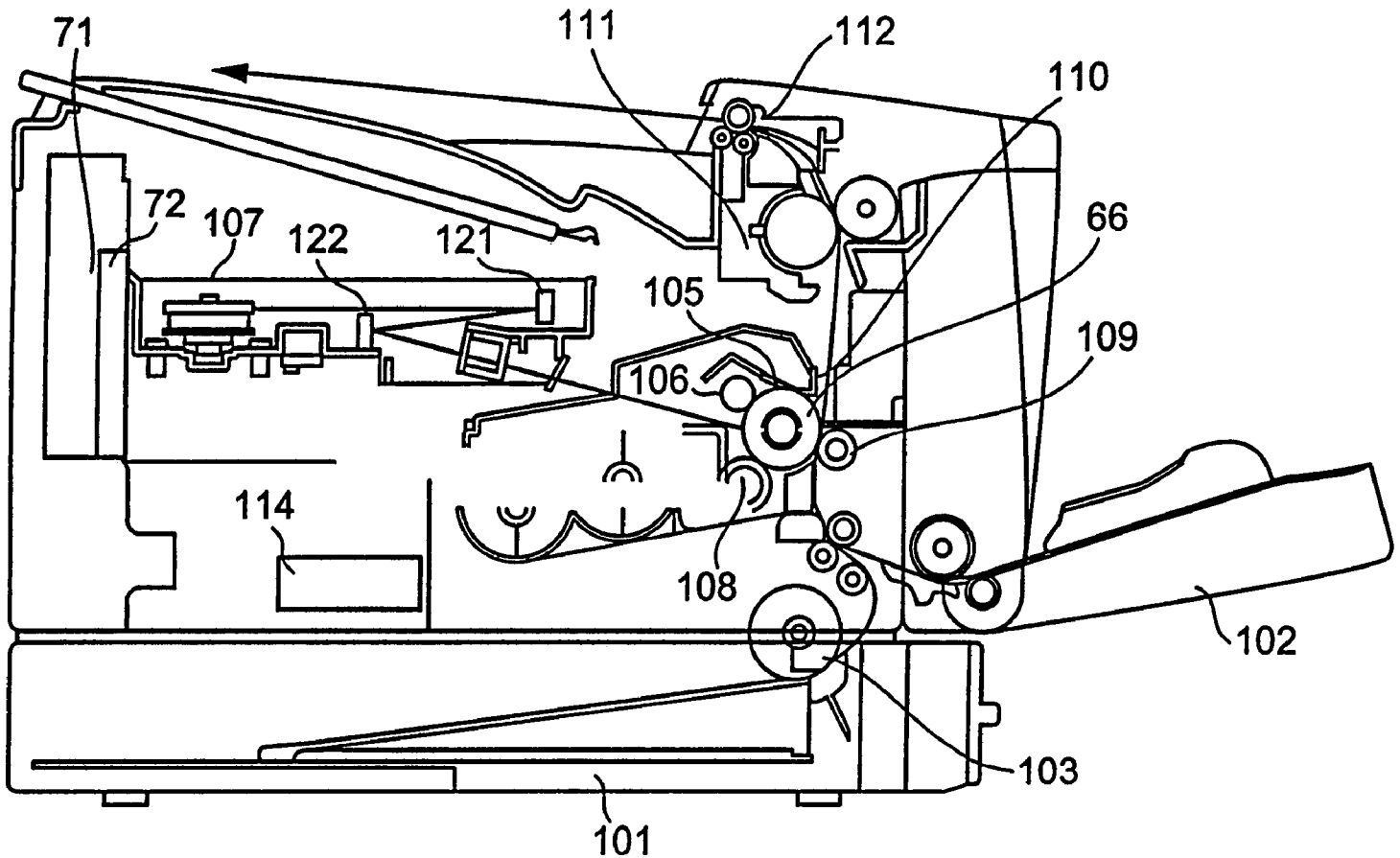
FIG. 1 is a cross sectional view generally showing an image forming apparatus according to the present invention.

FIG. 1 is a cross sectional view generally showing an image forming apparatus according to the present invention. In the image forming apparatus shown in FIG. 1, a paper on which an image is to be formed, is set on a main tray 101 or a manual feed tray 102. Of course, any recording media or sheet other than paper may be used. A transport of this paper from the tray 101 or 102 is started by paper supply rollers 103.

Prior to the paper transport by the paper supply rollers 103, a photoconductive body (photoconductive drum) 66 rotates, and a surface of the photoconductive body 66 is cleaned by a cleaning blade 105. Then, the surface of the photoconductive body 66 is uniformly charged by a charge roller 106. A laser beam which is modulated according to an image signal from a video controller 71 received via a laser diode (LD) driving circuit 72 is emitted from a laser optical system unit 107, and this laser beam exposes the charged surface of the photoconductive body 66. The exposed surface of the photoconductive body 66 is developed by a developing roller 108 and applied with a toner. At the same time, the paper is supplied by the paper supply rollers 103 at an appropriate timing.

The paper supplied from the paper supply rollers 103 is transported in a state pinched between the photoconductive body 66 and a transfer roller 109, and at the same time, a toner image is transferred onto the paper. Residual toner on the photoconductive body 66 is removed by the cleaning blade 105.

A toner density sensor 110 is provided in front of the cleaning blade 105, and it is possible to measure a density of the toner image formed on the photoconductive body 66 by the toner density sensor 110. In addition, the paper having the toner image transferred thereon is transported to a fixing unit 111 via a transport path, and the toner image is fixed on the paper by the fixing unit 111.

The printed paper having the fixed image thereon is ejected, face down, via ejection rollers 112, so that the surface of the printed paper having the fixed image faces down. When a plurality of printed papers are ejected, the papers are ejected in the order of pages.

The video controller 71 and the laser diode driving circuit 72 are connected to the laser optical system unit 107. The video controller 71 controls image signals from a personal computer, a work station and the like, and generates an evaluation charge (test pattern) signal which is held therein.

A high-voltage bias is applied to the developing roller 108 by a bias circuit 114. By controlling the bias by the bias circuit 114, it is possible to control the total tone of the image.

Figure 2:
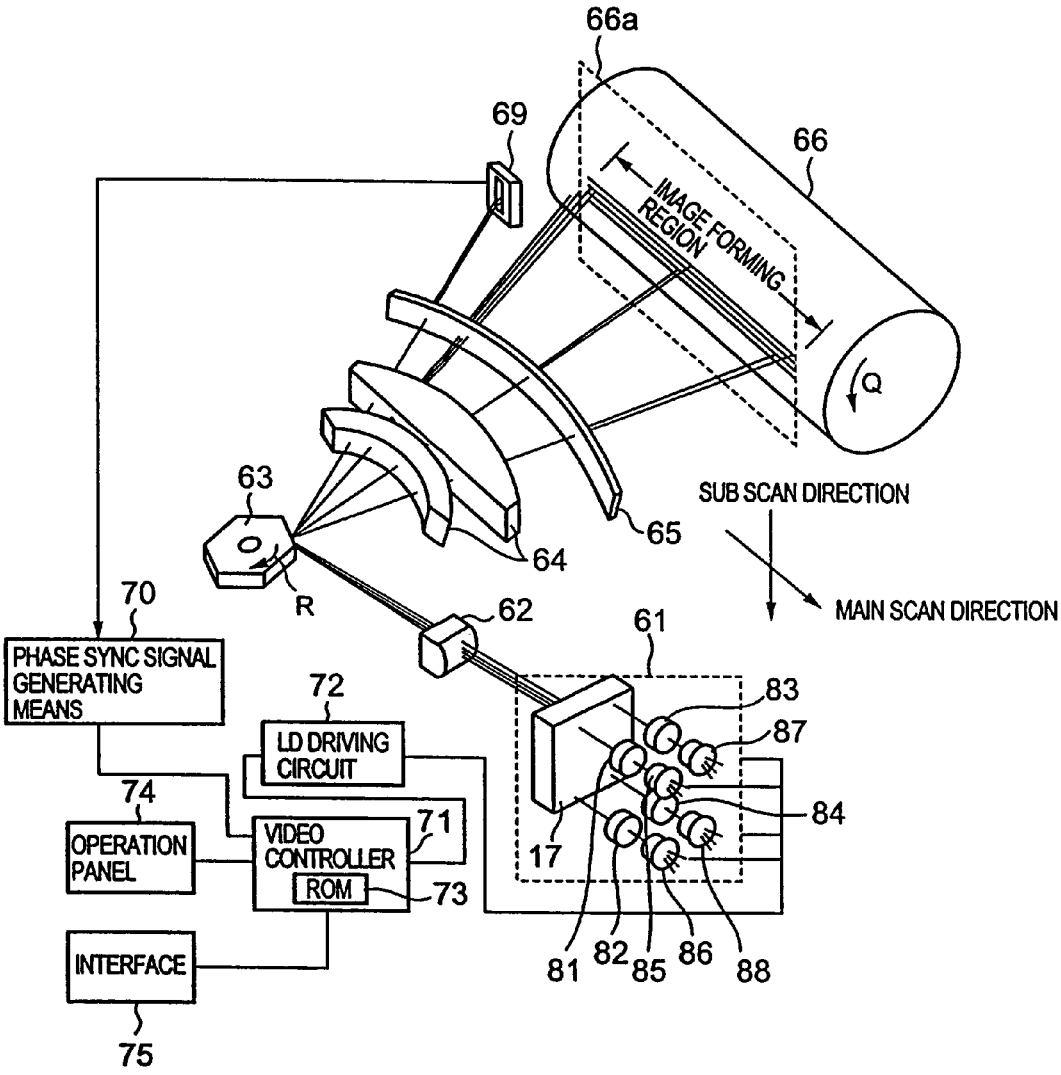
FIG. 2 is a diagram showing a general structure of a laser optical system unit.

FIG. 2 is a diagram showing a general structure of the laser optical system unit 107. In the laser optical system unit 107 shown in FIG. 2, two mirrors 121 and 122 are used as shown in FIG. 1 in order to reduce the size of the laser optical system unit 107. However, the illustration of the mirrors 121 and 122 is omitted in FIG. 2 for the sake of convenience in order to simplify the drawing.

As shown in FIG. 2, the laser optical system unit 107 includes a light source portion 61, a cylindrical lens 62, a polygon mirror 63 which is used as a deflecting means, a fθ lens 64, and a toroidal lens 65.

In the case shown in FIG. 2, the light source portion 61 includes four semiconductor lasers 85, 86, 87 and 88, four collimator lenses 81, 82, 83 and 84, and a prism 17. Four light beams from the four semiconductor lasers 85, 86, 87 and 88 are formed into approximately parallel rays by the corresponding collimator lenses 81, 82, 83 and 84, and the four light beams are thereafter aligned approximately to one vertical column by the prism 17.

Next, a description will be given of an operation of the image forming apparatus having the structure described above. In the light source portion 61, the four light beams from the four semiconductor lasers 85, 86, 87 and 88 are converted into the approximately parallel rays by the corresponding collimator lenses 81, 82, 83 and 84, and the four light beams are thereafter aligned approximately to one vertical column by the prism 17, as described above. The four aligned light beams pass through the cylindrical lens 62 and reach the polygon mirror 63.

The polygon mirror 63 rotates in a direction R in FIG. 2, and deflects the four incoming light beams in a horizontal direction, that is, in a main scan direction.

The four light beams deflected in the main scan direction passes through the fθ lens 64 and the toroidal lens 65, and scan the photoconductive body 66 at the same speed.

In the case shown in FIG. 1, the mirrors 121 and 122 are provided in the optical path at an intermediate portion of the optical system.

In FIG. 2, a horizontal synchronizing sensor 69 is provided at a scan starting end of the light beam in the main scan direction. An output of the horizontal synchronizing sensor 69 is used to achieve synchronization in the main scan direction. The horizontal synchronizing sensor 69 is arranged at the scan starting end outside an image forming region 66*a*. The photoconductive body 66 rotates in a direction Q shown in FIG. 2, and a latent image formed in the image forming region on the photoconductive body 66 is visualized by the developing roller 108.

The image forming apparatus is also provided with an operation panel 74 as shown in FIG. 2. The operation panel 74 is used to display an operating state of the image forming apparatus, and is used to set the operation mode and to set data during operation.

The data to be printed on the paper is transferred from an interface 75 to the video controller (video control circuit) 71 which converts the data into a bit map data. The bit map data from the video controller 71 is supplied to the laser diode driving circuit 72 which modulates the four semiconductor lasers 85, 86, 87 and 88 by the bit map data in synchronism with the horizontal synchronizing signal received from a phase synchronizing signal generating means 70.

First Embodiment:

In a first embodiment of the image forming apparatus according to the present invention, the plurality of light beams emitted from the light source portion 61 are deflected by the polygon mirror 63 which forms the deflecting means and simultaneously scan the photoconductive body 66 in the main scan directibn. This image forming apparatus forms a digital copying machine, a printer and the like, and is characterized in that an evaluation chart which will be described hereunder is output. The evaluation chart includes first patterns and second patterns. In the first pattern, with respect to a row of dots formed in the main scan direction by one predetermined light beam, a row of dots formed by the next one light beam is shifted in the main scan direction. In the second pattern, with respect to the row of dots formed in the main scan direction by one predetermined light beam, a row of dots formed by the next one light beam is shifted in the main scan direction but in a direction opposite to the shift direction of the first pattern. The evaluation chart actually includes a first pattern group which is formed by the first patterns which are repeated in the sub scan direction with a period that is an integer multiple of the number of light beams and are also repeated in the main scan direction at predetermined intervals, and a second pattern group which is formed by the second patterns which are repeated in the sub scan direction with a period that is an integer multiple of the number of light beams and are also repeated in the main scan direction at predetermined intervals.

FIGS. 3A, 3B, 4, 5, 6A, 6B, 7A, 7B, 8A, 8B and 9 are diagrams for explaining the evaluation chart used in this first embodiment. In FIGS. 3A through 9, it is assumed for the sake of convenience that the number of semiconductor lasers is four as shown in FIG. 2, and light beams B1, B2, B3 and B4 are respectively emitted from the four semiconductor lasers 85, 86, 87 and 88.

Figure 3A:
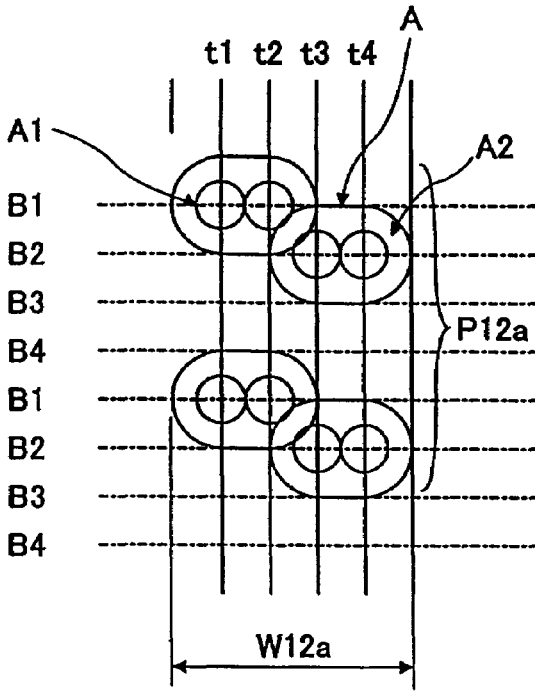
FIGS. 3A and 3B are diagrams for explaining an evaluation chart used in a first embodiment.
Figure 3B:
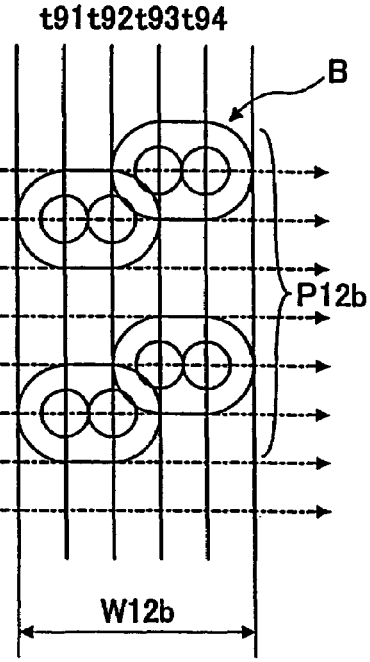

FIG. 3A is a diagram for explaining a first pattern A, and FIG. 3B is a diagram for explaining a second pattern B. In FIGS. 3A and 3B, each dot is indicated by a circular mark.

The first pattern A includes image patterns A1 and A2, as shown in FIG. 3A. In the image pattern A1, a row of dots formed on the photoconductive body 66 in the main scan direction by one predetermined light beam, that is, the first light beam B1 from the semiconductor laser 85, for example, is repeated in the sub scan direction with a period which is an integer multiple (integer is one in the case shown in FIG. 3A) of a number nb of light beams used. In this case, nb=4. In addition, in the image pattern A2, a row of dots formed on the photoconductive body 66 in the main scan direction by the next one light beam B2 from the semiconductor laser 86 is repeated in the sub scan direction with a period which is an integer multiple (integer is one in the case shown in FIG. 3A) of the number nb (=4) of light beams used.

The second pattern B is a mirror image of the first pattern A taken along the main scan direction, as shown in FIG. 3B. In other words, in the case of the second pattern B, with respect to the row of dots formed by one predetermined light beam in the main scan direction, the row of dots formed by the next light beam in the main scan direction is shifted in a direction opposite to the shift direction of the first pattern A.

The first pattern A is repeated in the main scan direction and the sub scan direction to form a first pattern group P12*a*, and the second pattern B is repeated in the main scan direction and the sub scan direction to form a second pattern group P12*b*, as shown in FIGS. 3A and 3B.

FIGS. 3A and 3B show the case where the optical system used emits the four light beams, that is, the top light beam B1 through the bottom light beam B4, and the four light beams B1 through B4 simultaneously scan in the main scan direction. In FIG. 3A, the light beam B1 exposes the row of dots at phases t1 and t2 in the horizontal direction, as indicated by the circular marks, and the image pattern A1 is exposed as a result. By this exposure of the image pattern A1, the toner image is adhered on the photoconductive body 66 in an approximately oval region surrounding the image pattern A1. Similarly, the image pattern A2 is exposed by the light beam B2, and the toner image is adhered on the photoconductive body 66 in an approximately oval region surrounding the image pattern A2. The first pattern A is formed by these image patterns A1 and A2.

As shown in FIG. 3B, the second pattern B is the mirror image of the first pattern A shown in FIG. 3A taken along the main scan direction. Hence, the toner images are also adhered on the photoconductive body 66 in approximately oval regions respectively surrounding the image patterns forming the second pattern B.

Figure 4:
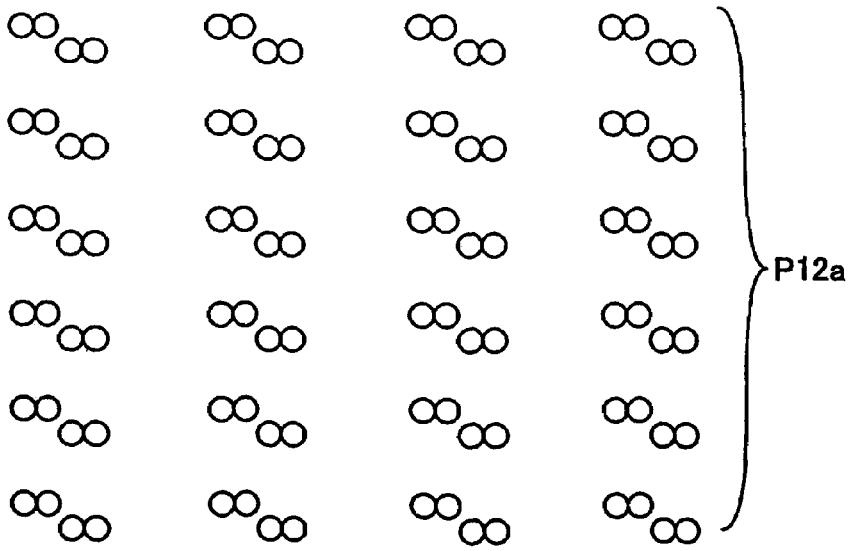
FIG. 4 is a diagram for explaining the evaluation chart used in the first embodiment.
Figure 5:
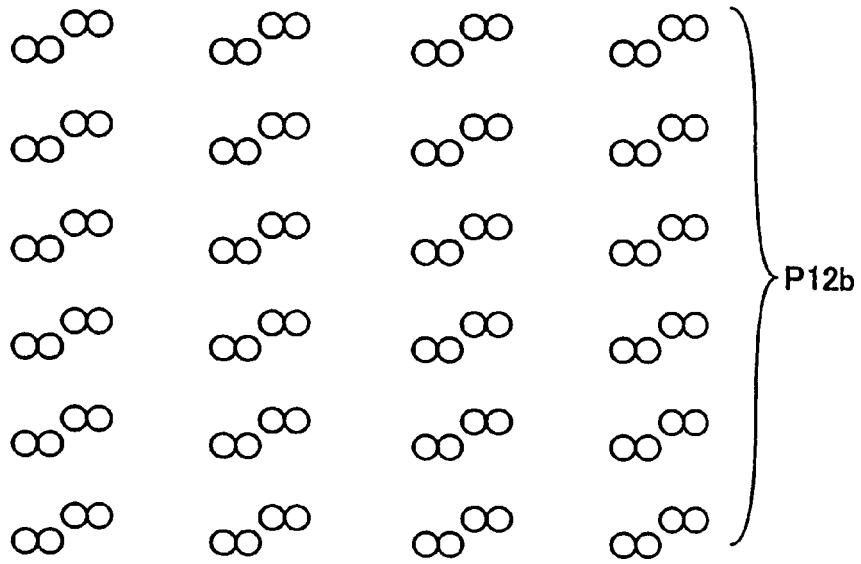
FIG. 5 is a diagram for explaining the evaluation chart used in the first embodiment.

FIG. 4 shows the first pattern group P12*a* which is formed by repeating the first pattern A shown in FIG. 3A in both the main scan direction and the sub scan direction. Similarly, FIG. 5 shows the second pattern group P12*b* which is formed by repeating the second pattern B shown in FIG. 3B in both the main scan direction and the sub scan direction.

Therefore, in FIGS. 3A and 3B, the first and second pattern groups P12*a* and P12*b* are formed by the light beams B1 and B2.

Figure 6A:
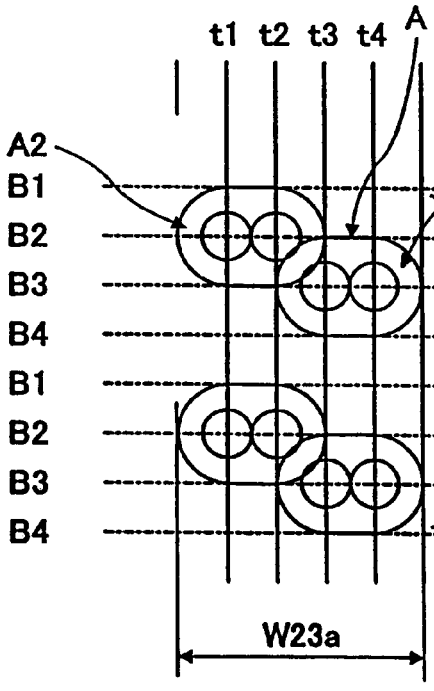
FIGS. 6A and 6B are diagrams for explaining the evaluation chart used in the first embodiment.
Figure 6B:
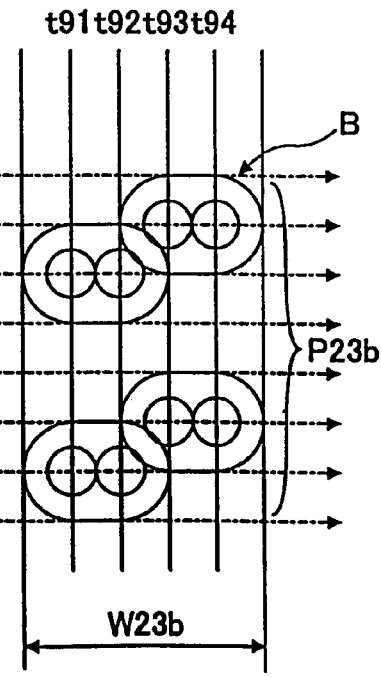

Similarly, first and second pattern groups P23*a* and P23*b* respectively shown in FIGS. 6A and 6B are formed by the light beams B2 and B3. In other words, the first pattern group P23*a* is formed by repeating the first pattern A (A2, A3) in both the main scan direction and the sub scan direction in FIG. 6A, and the second pattern group P23*b* is formed by repeating the second pattern B in both the main scan direction and the sub scan direction in FIG. 6B.

Figure 7A:
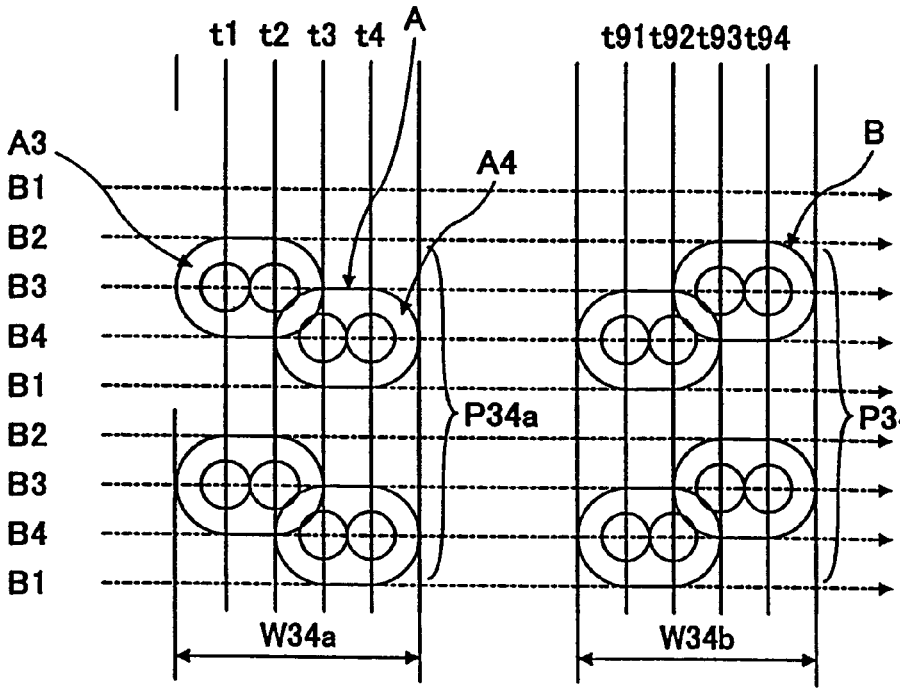
FIGS. 7A and 7B are diagrams for explaining the evaluation chart used in the first embodiment.
Figure 7B:
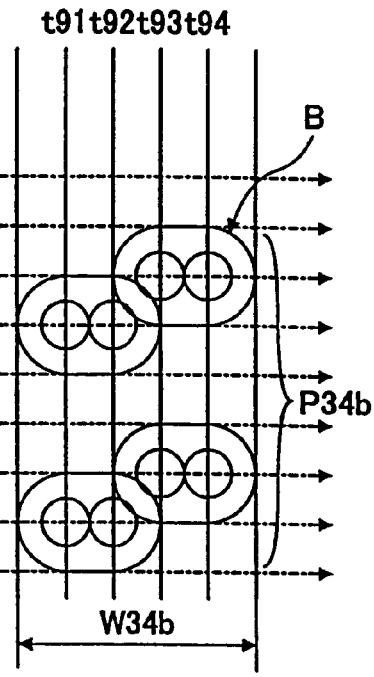

In addition, first and second pattern groups P34*aa* and P34*b* respectively shown in FIGS. 7A and 7B are formed by the light beams B3 and B4. In other words, the first pattern group P34*a* is formed by repeating the first pattern A (A3, A4) in both the main scan direction and the sub scan direction in FIG. 7A, and the second pattern group P34*b* is formed by repeating the second pattern B in both the main scan direction and the sub scan direction in FIG. 7B.

Figure 8A:
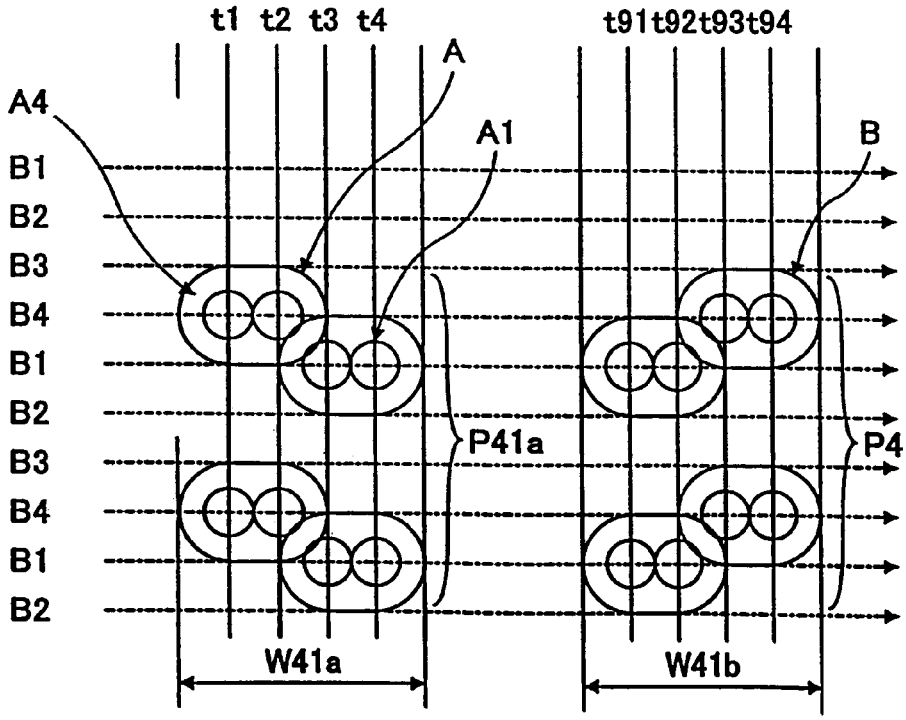
FIGS. 8A and 8B are diagrams for explaining the evaluation chart used in the first embodiment.
Figure 8B:
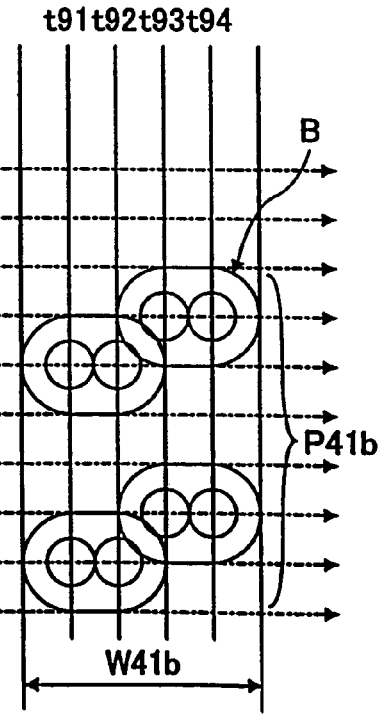

Furthermore, first and second pattern groups P41*a* and P41*b* respectively shown in FIGS. 8A and 8B are formed by the light beams B4 and B1. In other words, the first pattern group P41*a* is formed by repeating the first pattern A (A4, A1) in both the main scan direction and the sub scan direction in FIG. 8A, and the second pattern group P41*b* is formed by repeating the second pattern B in both the main scan direction and the sub scan direction in FIG. 8B.

Figure 9:
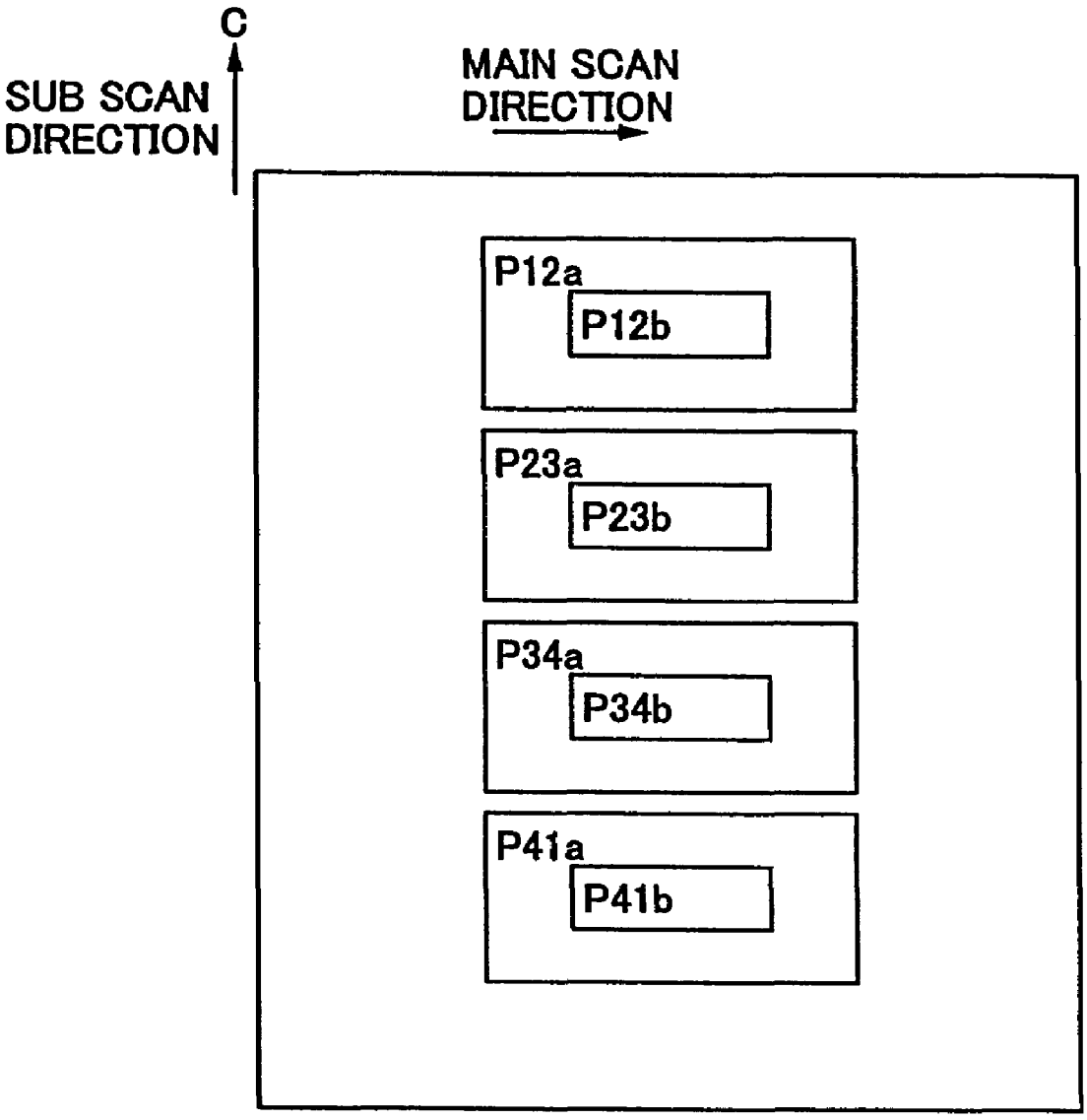
FIG. 9 is a diagram for explaining the evaluation chart used in the first embodiment.

FIG. 9 shows the evaluation chart which includes the first pattern groups P12*a*, P23*a*, P34*a* and P41*a* and the second pattern groups P12*b*, P23*b*, P34*b* and P41*b* which are printed on the paper. In FIG. 9, a paper transport direction (sub scan direction) is indicated by an arrow C. In the evaluation chart shown in FIG. 9, a print region of the second pattern group P12*b* is provided inside a print region of the first pattern group P12*a*, so that the first pattern group P12*a* is printed in the print region of the first pattern group P12*a* and the second pattern group P12*b* is printed in the print region of the second pattern group P12*b* inside the print region of the first pattern group P12*a*. Print regions of the first pattern groups P23*a*, P34*a* and P41*a* and print regions of the second pattern groups P23*b*, P34*b* and P41*b* are set similarly to the print regions of the first and second pattern groups P12*a* and P12*b* described above.

If a phase error exists in the main scan direction between the light beams B1 and B2, for example, the print tone of the first pattern group P12*a* and the print tone of the second pattern group P12*b* become different in the evaluation chart. Hence, it is possible to detect the phase error in the main scan direction between the light beams B1 and B2 based on the print tones of the first and second pattern groups P12*a* and P12*b* printed on the evaluation chart.

Figures 10A, 10B:
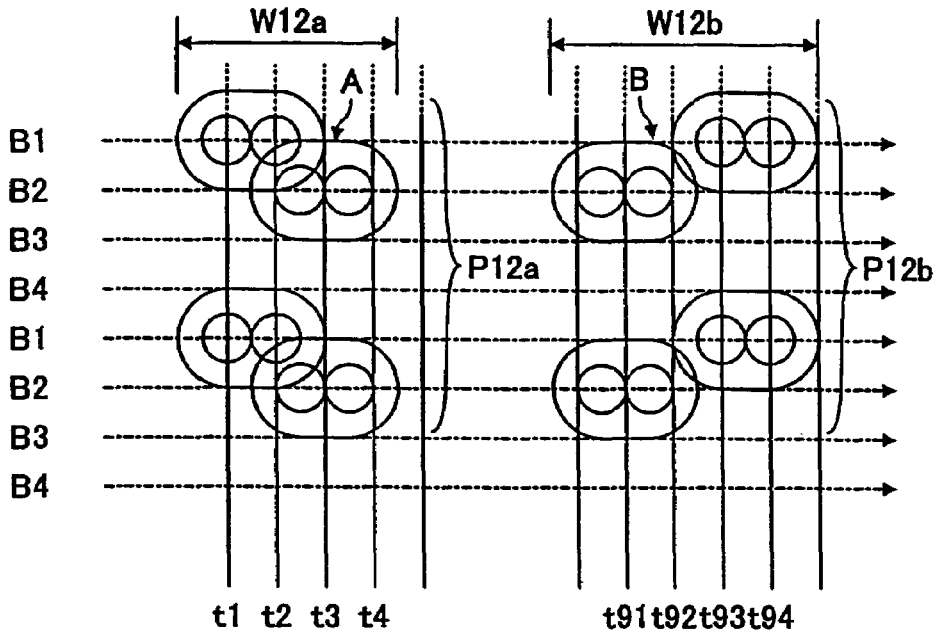
FIGS. 10A and 10B are diagrams for explaining a phase error of light beams in a main scan direction.

FIGS. 10A and 10B are diagrams for explaining the phase error of the light beams B1 and B2 in the main scan direction, respectively in correspondence with FIGS. 3A and 3B. If there is no phase error in the main scan direction between the light beams B1 and B2 as shown in FIGS. 3A and 3B, a width W12*a* of the toner image of the first pattern A is equal to a width W12*b* of the toner image of the second pattern B. Hence, the print tone of the first pattern group P12*a* formed by the first pattern A in this case becomes the same as the print tone of the second pattern group P12*b* formed by the second pattern B.

On the other hand, if the phase error in the main scan direction between the light beams B1 and B2 amounts to one-half dot (the phase of the light beam B2 is shifted by one-half dot) as shown in FIGS. 10A and 10B due to a mounting error, adjustment error or the like of the semiconductor lasers 85 and 86, the width W12*a* of the toner image of the first pattern A and the width W12*b* of the toner image of the second pattern B become different. When the phase error in the main scan direction exists between the light beams B1 and B2, the width and the area of the region where the toner is adhered becomes different between the first pattern A and the second pattern B, and results in the difference between the image tone of the first pattern group P12*a* and the image tone of the second pattern group P12*b*. The difference between the widths or the tones of the toner images can be detected as a regular and sharp width difference or tone deviation on the image patterns which should originally be a uniform half-tone image. For this reason, it is possible to detect the difference between the widths or the tones of the toner images with an extremely high sensitivity even when relying on visual detection by the human eyes.

Figures 11A, 11B:
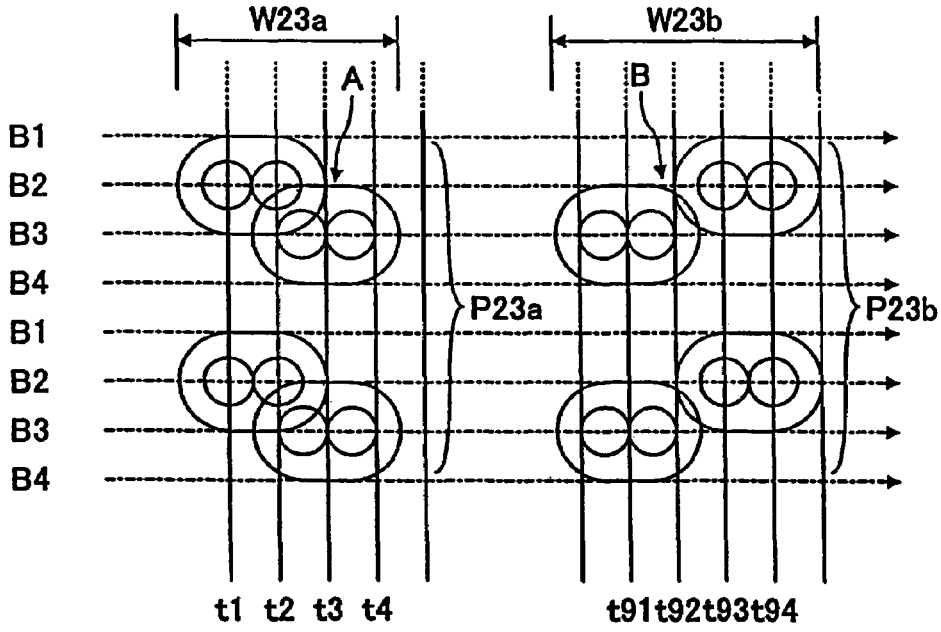
FIGS. 11A and 11B are diagrams for explaining the phase error of the light beams in the main scan direction.

Similarly, if the phase error in the main scan direction exists between the light beams B2 and B3 as shown in FIGS. 11A and 11B, a width W23*a* of the toner image of the first pattern A and a width W23*b* of the toner image of the second pattern B become different. The difference between the widths W23*a* and W23*b* of the toner images can be detected as a difference in the image tones of the first and second pattern groups P23*a* and P23*b*.

In addition, if the phase error in the main scan direction exists between the light beams B3 and B4 as shown in FIGS. 12A and 12B, a width W34*a* of the toner image of the first pattern A and a width W34*b* of the toner image of the second pattern B become different. The difference between the widths W34*a* and W34*b* of the toner images can be detected as a difference in the image tones of the first and second pattern groups P34*a* and P34*b*.

Furthermore, if the phase error in the main scan direction exists between the light beams B4 and B1 as shown in FIGS. 13A and 13B, a width W41*a* of the toner image of the first pattern A and a width W41*b* of the toner image of the second pattern B become different. The difference between the widths W41*a* and W41*b* of the toner images can be detected as a difference in the image tones of the first and second pattern groups P41*a* and P41*b*.

In the case of the evaluation chart shown in FIG. 9, the image region of the second pattern group P12*b* is printed inside the image region of the first pattern group P12*a*, the image region of the second pattern group P23*b* is printed inside the image region of the first pattern group P23*a*, the image region of the second pattern group P34*b* is printed inside the image region of the first pattern group P34*a*, and the image region of the second pattern group P41*b* is printed inside the image region of the first pattern group P41*a*. Hence, the first pattern groups P12*a*, P23*a*, P34*a* and P41*a* are respectively arranged close to the corresponding second pattern groups P12*b*, P23*b*, P34*b* and P41*b*, and it is possible to easily and accurately detect visually the difference between the image tones of the first pattern group and the corresponding second pattern group. In other words, it is possible to visually detect even a slight phase error between two light beams. For example, when it is visually detected that there is a difference between the image tone of the first pattern group P12*a* and the image tone of the second pattern group P12*b* in the evaluation chart shown in FIG. 9, it can be detected that a phase error exists between the light beams B1 and B2.

Figure 14:
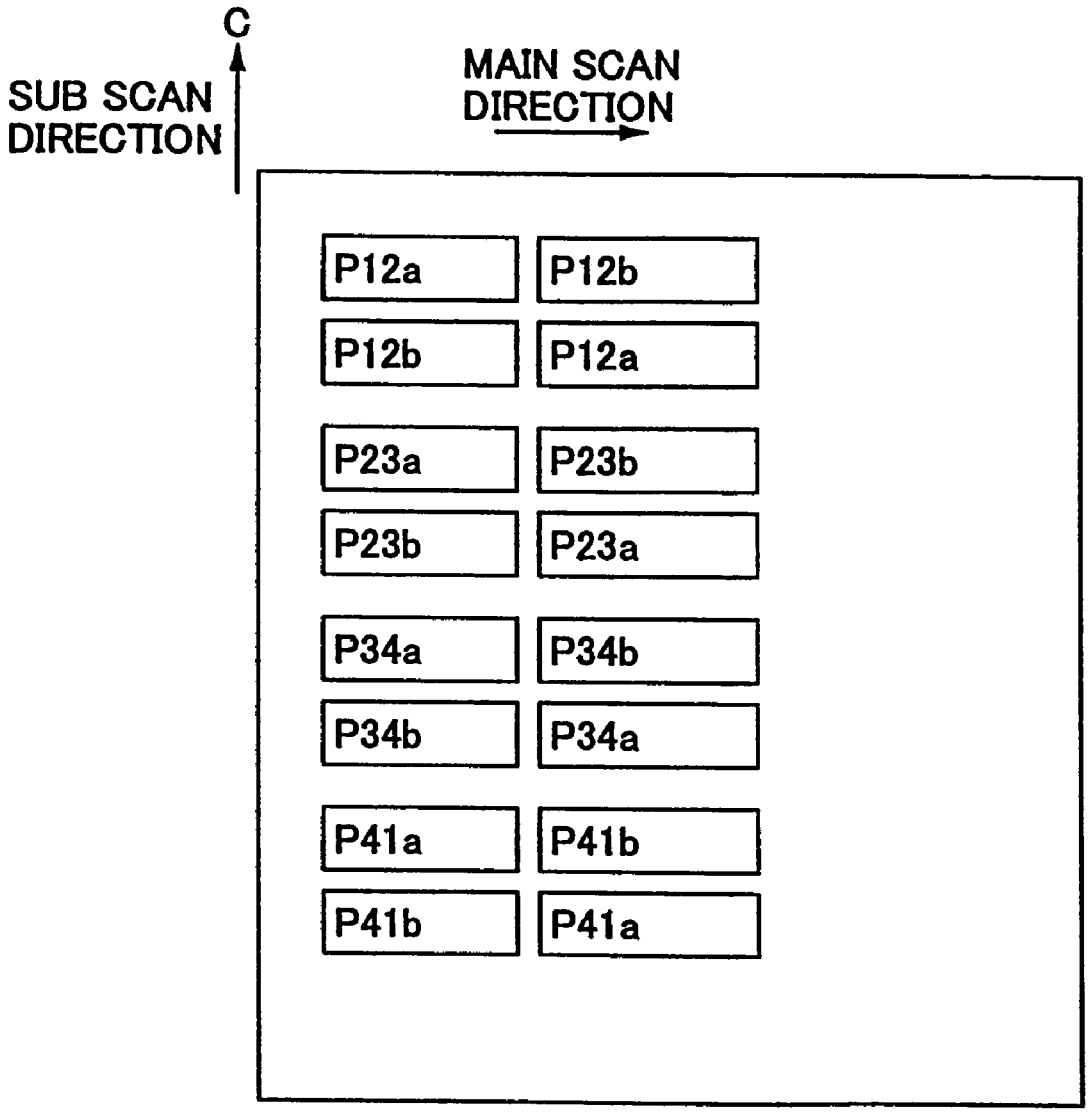
FIG. 14 is a diagram for explaining another evaluation chart used in the first embodiment.

FIG. 14 is a diagram for explaining another evaluation chart used in this first embodiment. In FIG. 14, those parts which are the same as those corresponding parts in FIG. 9 are designated by the same reference numerals, and a description thereof will be omitted. In the evaluation chart shown in FIG. 14, two first pattern groups P12*a*, two second pattern groups P12*b*, two first pattern groups P23*a*, two second pattern groups P23*b*, two first pattern groups P34*a*, two second pattern groups P34*b*, two first pattern groups P41*a*, and two second pattern groups P41*b* are arranged as shown, so that each first pattern group has one corresponding second pattern group arranged adjacent thereto in both the main scan direction and the sub scan direction, and each second pattern group has one corresponding first pattern group arranged adjacent thereto in both the main scan direction and the sub scan direction. For example, the first pattern group P12*a* has one corresponding second pattern group P12*b* arranged adjacent thereto in the main scan direction (to the right or left) and one corresponding second pattern group P12*b* arranged adjacent thereto in the sub scan direction (below or above). Similarly, the second pattern group P12*b* has one corresponding first pattern group P12*a* arranged adjacent thereto in the main scan direction (to the left or right) and one corresponding first pattern group P12*a* arranged adjacent thereto in the sub scan direction (above or below).

When detecting the phase error between the light beams B1 and B2 using the evaluation chart shown in FIG. 14, for example, it is possible to compare the top left first pattern group P12*a* and the top right second pattern group P12*b* or the lower left second pattern group P12*b*. For this reason, even if the developing process introduces unevenness in the main scan direction and/or in the sub scan direction, it is possible to effectively and accurately detect the phase error between the light beams B1 and B2.

In addition, when generating the image data of the first and second pattern-groups by hardware such as the video controller 71, it is simpler to design the circuit if the image regions of the first and second pattern groups are independent of each other and rectangular as shown in FIG. 14, compared to the case where the image regions of the first and second pattern groups overlap as shown in FIG. 9.

The first and second pattern groups, such as the first and second pattern groups P12*a* and P12*b*, which are to be mutually compared, may be printed on independent papers. However, it is desirable that the corresponding first and second pattern groups are printed on the same paper, and adjacent to each other, as shown in FIGS. 9 and 14, so as to facilitate the comparison. When the corresponding first and second pattern groups are printed on the same paper, and adjacent to each other, it is possible to effectively reduce the possibility of being affected by the unevenness in the tone introduced in the main scan direction and/or the sub scan direction during the developing process.

Therefore, this first embodiment of the present invention is characterized in that the image forming apparatus outputs an evaluation chart including a first pattern group made up of first patterns which are repeated in a sub scan direction with a period that is an integer multiple of a number of light beams used and are also repeated in a main scan direction at predetermined intervals, and a second pattern group made up of second patterns which are repeated in the sub scan direction with a period which is an integer multiple of the number of light beams used and are also repeated in the main scan direction at predetermined intervals, where each first pattern has, with respect to a row of dots formed in the main scan direction by a predetermined light beam, a row of dots formed by a next light beam and shifted in the main scan direction, and each second pattern has, with respect to a row of dots formed in the main scan direction by a predetermined light beam, a row of dots formed by a next light beam and shifted in the main scan direction but in a direction opposite to a shift direction of the first pattern. In addition, the evaluation chart is characterized in that, of a plurality of light beams (B1, B2, . . . , Bm, Bm≧2), the first and second pattern groups formed by the light beams B1 and B2, the first and second pattern groups formed by the light beams B2 and B3, . . . , the first and second pattern groups formed by the light beams B(m−1) and Bm, and the first and second pattern groups formed by the light beams Bm and B1 are printed on the same paper.

Second Embodiment:

In a second embodiment of the image forming apparatus according to the present invention, the plurality of light beams emitted from the light source portion 61 are deflected by the polygon mirror 63 which forms the deflecting means and simultaneously scan the photoconductive body 66 in the main scan direction. This image forming apparatus is characterized in that an evaluation chart which will be described hereunder is output. The evaluation chart includes first patterns and second patterns. In the first pattern, with respect to a row of dots formed in the main scan direction by one predetermined light beam, a row of dots formed by the next one light beam is shifted in the main scan direction. In the second pattern, with respect to the row of dots formed in the main scan direction by one predetermined light beam, a row of dots formed by the next one light beam is shifted in the main scan direction but in a direction opposite to the shift direction of the first pattern. The evaluation chart actually includes a first pattern group which is formed by the first patterns which are repeated in the sub scan direction with a period that is an integer multiple of the number of light beams, and a second pattern group which is formed by the second patterns which are repeated in the sub scan direction with a period that is an integer multiple of the number of light beams.

Figure 15:
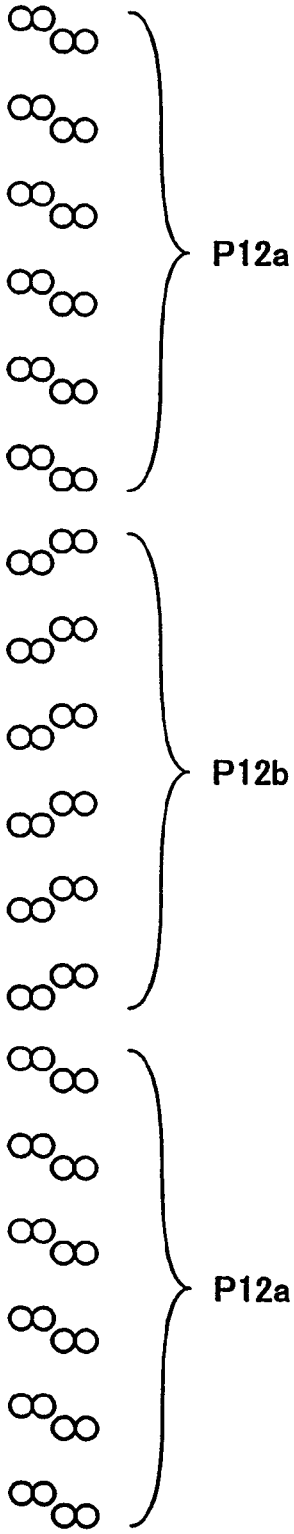
FIG. 15 is a diagram for explaining an evaluation chart used in a second embodiment.

FIG. 15 is a diagram for explaining the evaluation chart used in this second embodiment. As shown in FIG. 15, the first pattern group P12*a* and the second pattern group P12*b* are not repeated in the main scan direction on the evaluation chart used in this second embodiment. In other words, the first and second pattern groups P12*a* and P12*b* are repeated in only the sub scan direction with the period which is an integer multiple (integer is one in the case shown in FIG. 15) of the number of light beams used (two light beams in the case shown in FIG. 15), in a sequence P12*a*, P12*b*, P12*a*, . . . .

As described above, if the phases of the two adjacent light beams differ, the width of the toner image of the first pattern A and the width of the toner image of the second pattern B become different.

Figure 16:
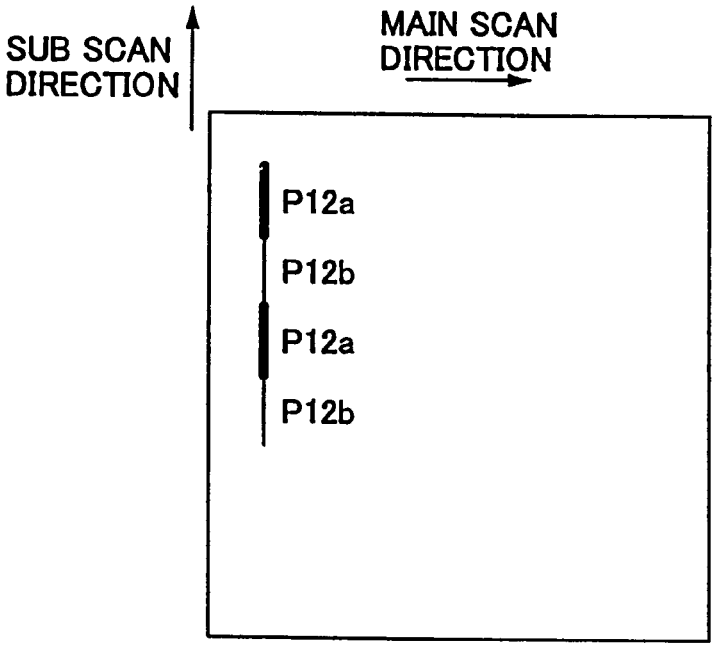
FIG. 16 is a diagram for explaining the evaluation chart used in the second embodiment.
Figure 17:
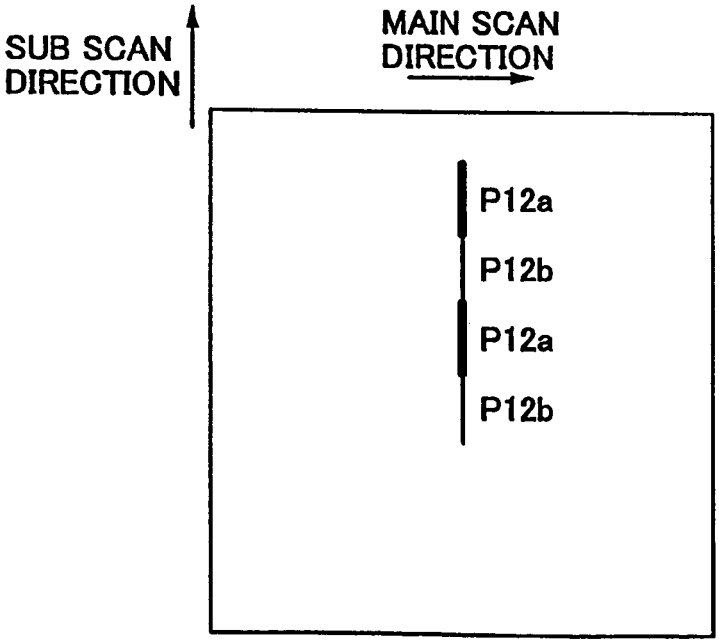
FIG. 17 is a diagram for explaining the evaluation chart used in the second embodiment.

FIGS. 16 and 17 are diagrams for explaining the evaluation charts used in the second embodiment. In the evaluation charts shown in FIGS. 16 and 17, the phases of the two adjacent light beams differ, and the widths of the toner images of the first and second patterns A and B differ. FIG. 16 shows the evaluation chart for a case where the first and second pattern groups arranged in the sub scan direction are disposed at the scan start side of the scan range of the polygon mirror 63. On the other hand, FIG. 17 shows the evaluation chart for a case where the first and second pattern groups arranged in the sub scan direction are disposed at the central portion of the scan range of the polygon mirror 63. By visually checking the evaluation chart shown in FIG. 16 or 17, it is possible to effectively detect the phase error between the light beams.

In the case of the evaluation chart shown in FIG. 16 in which the first and second pattern groups are disposed at the scan start side of the scan range of the polygon mirror 63, it is possible to simply detect the phase error between the light beams without being affected by an irregular rotation of the polygon mirror 63.

Figure 18:
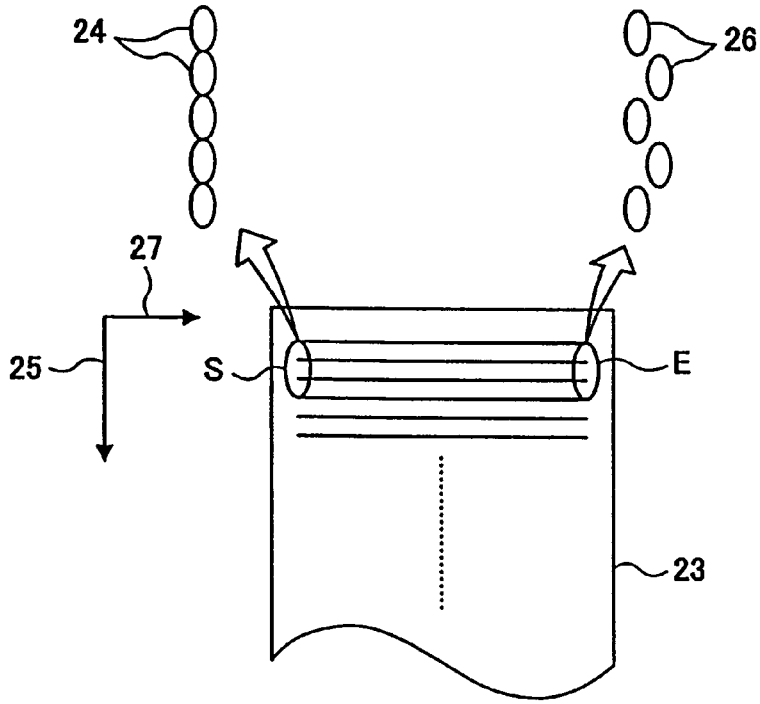
FIG. 18 is a diagram for explaining a dot position error caused by irregular rotation of a polygon motor.

FIG. 18 is a diagram for explaining a dot position error caused by the irregular rotation of a polygon motor which rotates the polygon mirror 63. In FIG. 18, 23 denotes the surface of the photoconductive body 66, 24 denote aligned dots, 25 denotes the sub scan direction, 26 denotes non-aligned dots, 27 denotes the main scan direction, S denotes the scan start side of the scan range of the polygon mirror 63, and E denotes the scan end side of the scan range of the polygon mirror 63.

In FIG. 18, at the scan start side S, the dots become aligned as indicated by the aligned dots 24. However, due to causes such as the irregular rotation of the polygon mirror, the dots may become non-aligned as indicated by the non-aligned dots 26 at the scan end side E. In this case, it is preferable to dispose the first and second pattern groups P12*a* and P12*b* at the scan start side of the scan range as shown in FIG. 16, in order to accurately detect the phase error between the adjacent light beams.

On the other hand, in a case where the irregular rotation of the polygon motor or the like are less likely to occur, it is preferable to dispose the first and second pattern groups P12*a* and P12*b* at the central portion of scan range as shown in FIG. 17, in order to accurately detect the phase error between the adjacent light beams.

In other words, as shown in FIG. 2, the light beams are corrected in the laser optical system, so that the laser beams are deflected by the polygon mirror 63 and scan the image forming region on the photoconductive body 66 through the fθ lens 64 and the toroidal lens 65 at the same speed. However, it is difficult to correct the light beams so that the scanning speeds become exactly the same. Consequently, a slight optical distortion is generated at the scan start side and the scan end side of the scan range in the main scan direction.

For this reason, when the first and second pattern groups P12*a* and P12*b* are disposed as shown in FIG. 17 at the central portion of the scan range, that is, the central portion of the image forming region where the optical distortion is small, it is possible to accurately detect the phase error between the adjacent light beams without being affected by the optical distortion caused by a lens or the like.

In the first pattern A and the second pattern B described heretofore, it is assumed for the sake of convenience that the number of rows of dots formed by each of the light beams B1 and B2 and aligned in the main scan direction is two, as shown in FIGS. 3A and 3B, for example. However, the number of rows of dots formed by one light beam and aligned in the main scan direction is of course not limited to two, and three or more rows of dots may be formed by one light beam.

Figure 19A:
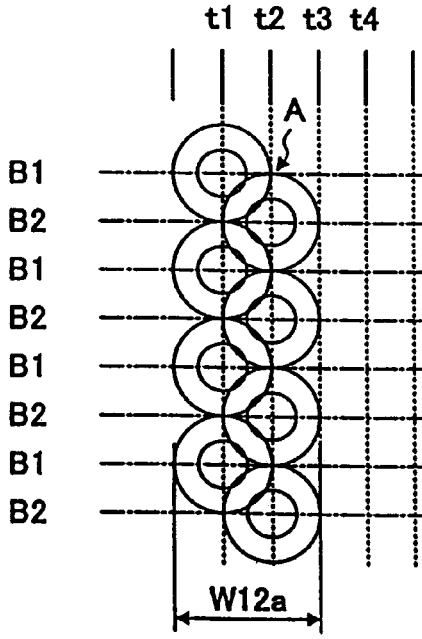
FIGS. 19A and 19B are diagrams for explaining a pattern for a case where the number of semiconductor lasers is two and the number of rows of dots formed by one light beam in a main scan direction is one.
Figure 19B:
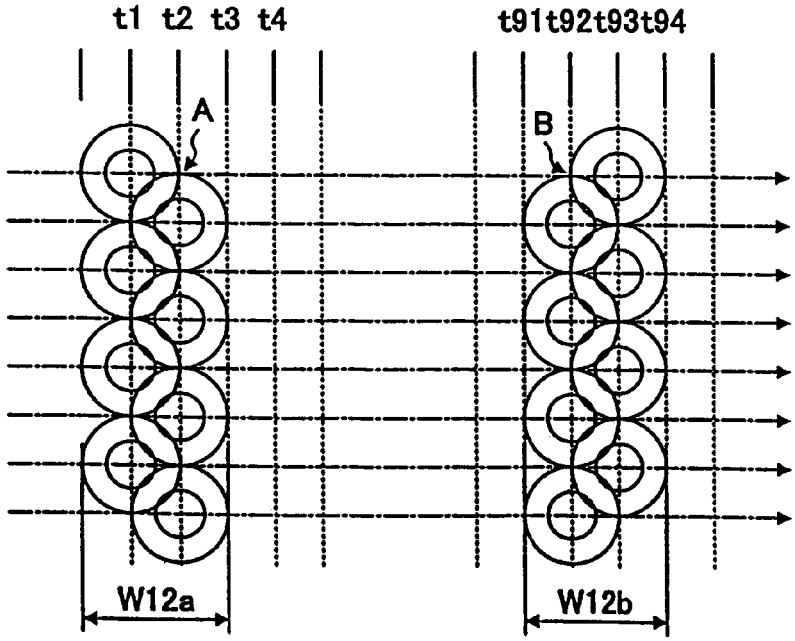

FIGS. 19A and 19B are diagrams for explaining a pattern for a case where the number of semiconductor lasers is two and the number of rows of dots formed by one light beam and aligned in the main scan direction is one. FIG. 19A shows the first pattern A, and FIG. 19B shows the second pattern B.

Figure 20A:
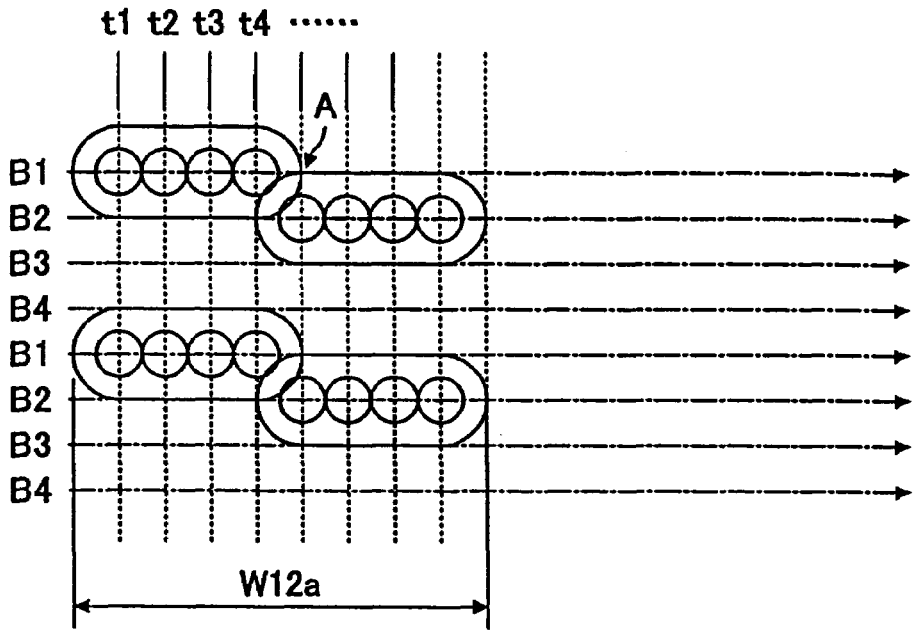
FIGS. 20A and 20B are diagrams for explaining a pattern for a case where the number of semiconductor lasers is four and the number of rows of dots formed by one light beam in the main scan direction is four.
Figure 20B:
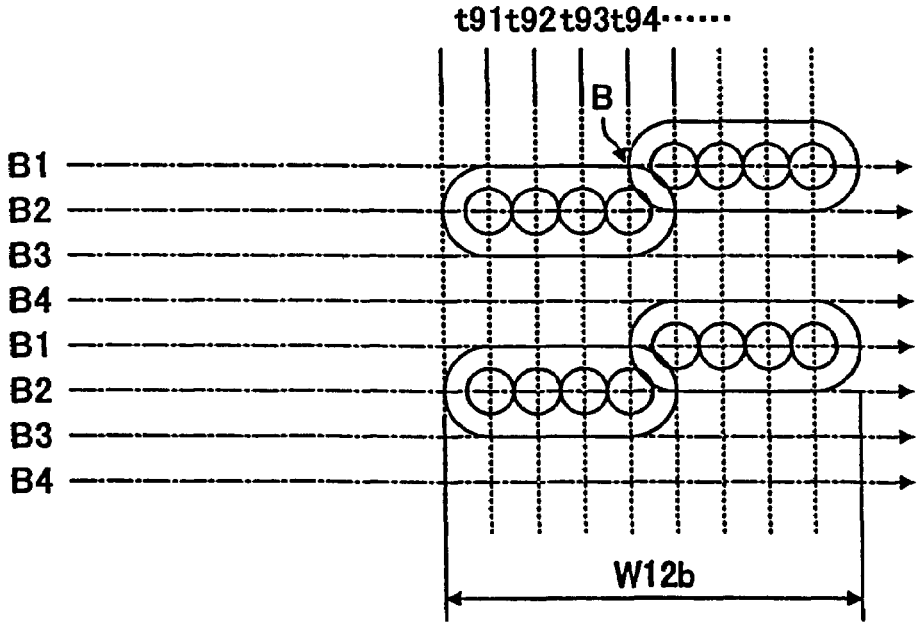

FIGS. 20A and 20B are diagrams for explaining a pattern for a case where the number of semiconductor lasers is four and the number of rows of dots formed by one light beam and aligned in the main scan direction is four. FIG. 20A shows the first pattern A, and FIG. 20B shows the second pattern B.

The present inventor tested various evaluation charts output by use of a 2-beam image forming apparatus (electrophotography engine) having a write resolution of 600 dpi. Of the various evaluation charts output, it was found that the phase error between the two light beams can be detected most effectively by use of the evaluation chart having one row of dots in the main scan direction as shown in FIGS. 19A and 19B.

In addition, the present inventor tested various evaluation charts output by use of a 4-beam image forming apparatus (electrophotography engine) having a write resolution of 1200 dpi. Of the various evaluation charts output, it was found that the phase error between two light beams can be detected most effectively by use of the evaluation chart having four rows of dots in the main scan direction as shown in FIGS. 20A and 20B.

Therefore, the number of rows of dots formed by one light beam on the evaluation chart may be changed depending on the image forming apparatus used and the write resolution employed.

Figure 21A:
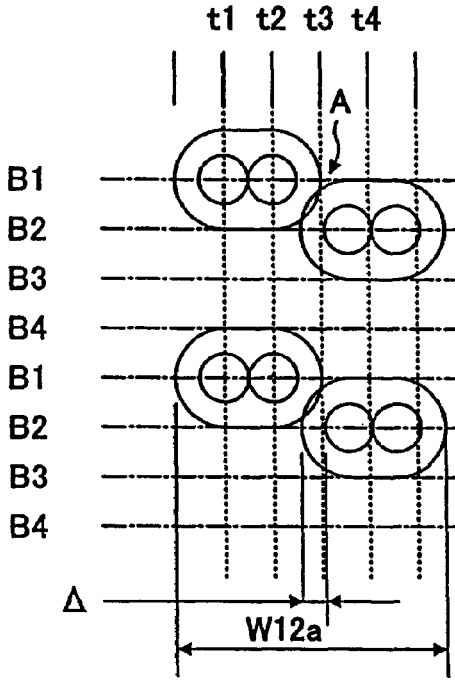
FIGS. 21A and 21B are diagrams for explaining first and second patterns A and B for a case where, with respect to a row of dots formed by a first light beam B1, a row of dots formed by a second light beam B2 has a distance deviation Δ in the main scan direction.
Figure 21B:
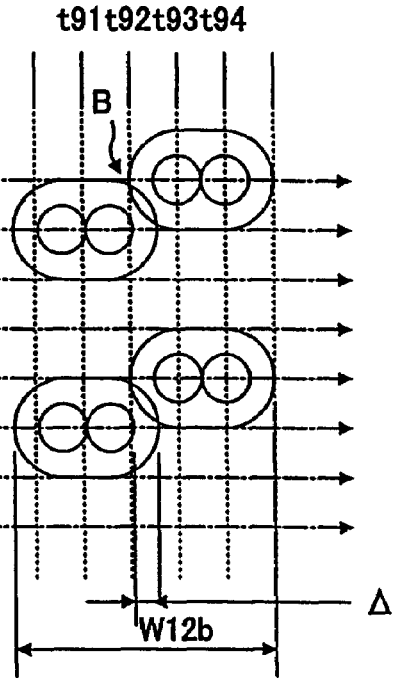

When outputting the evaluation chart, it is also possible to change the distance in the main scan direction between the row of dots formed in the main scan direction by one predetermined light beam and the row of dots formed in the main scan direction by the next one light beam. FIGS. 21A and 21B are diagrams for explaining the first and second patterns A and B similar to those shown in FIGS. 3A and 3B, but for a case where, with respect to a row of dots formed by a first light beam B1, a row of dots formed by a second light beam B2 has a distance deviation Δ in the main scan direction, as compared to FIGS. 3A and 3B. Because the row of dots formed by the second light beam B2 has the distance deviation Δ in the main scan direction with respect to the row of dots formed by the first light beam B1, the width W12*a* of the toner image of the first pattern A and the width W12*b* of the toner image of the second pattern B become as shown in FIGS. 21A and 21B, and it becomes possible to detect the phase error between the first and second light beams B1 and B2 with a higher sensitivity compared to the case shown in FIGS. 10A and 10B described above.

Figure 22A:
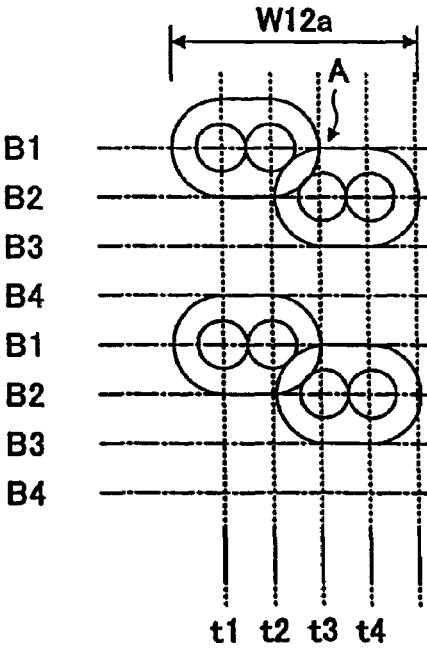
FIGS. 22A and 22B are diagrams for explaining a phase error of the light beams in the main scan direction.
Figure 22B:
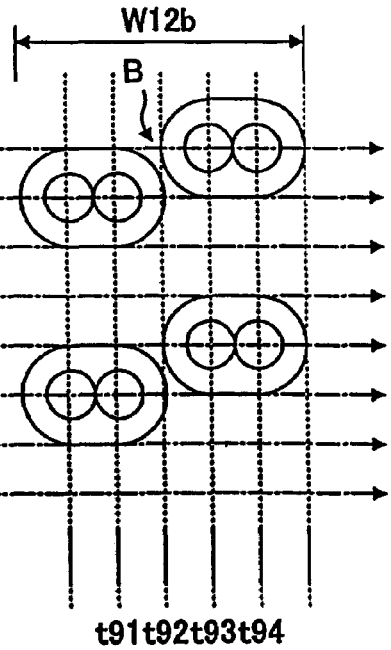

For example, in the image forming apparatus (electrophotography engine) having a write resolution of 1200 dpi, one dot is small, and it is not possible to obtain a sufficient potential drop by the exposure of one dot. For this reason, it becomes more difficult to form the toner images of the first and second patterns A and B if the distance deviation Δ is provided in the main scan direction between the rows of dots because an overlap of the dots will decrease. If the phase error exists in the main scan direction between the light beams, it is more difficult for the toner image to be formed if the distance deviation Δ increases as shown in FIG. 22B, and it is easier for the toner image to be formed if the distance deviation Δ decreases as shown in FIG. 22A. FIGS. 22A and 22B are diagrams for explaining the phase error of the light beams in the main scan direction. Therefore, it is possible to detect the phase error between the light beams with a high sensitivity by comparing the first and second patterns A and B shown in FIGS. 22A and 22B, that is, based on the difference between the first and second patterns A and B shown in FIGS. 22A and 22B.

The exposing position indicated by the circular mark and the toner adhering region indicated by the approximately oval mark in FIGS. 3A and 3B or FIGS. 21A and 21B change depending on the resolution and the shape of the laser beam used. The shape of the laser beam refers to the cross sectional shape of the laser beam or the shape of the laser beam spot formed on the surface of the photoconductive body 66. For this reason, it is important to appropriately set the number of dots and the distance deviation Δ.

Accordingly, because of the need to change the number of dots and the distance deviation Δ depending on the conditions such as the resolution, the shape of the laser beam, the developing condition (image forming condition) and the like, it is preferable to generate the evaluation chart by an electronic circuit in a case where one image forming apparatus has the function of forming images in either one of two resolutions, and to enable the number of dots forming the row of dots and the distance deviation Δ to be changed.

Figure 23:
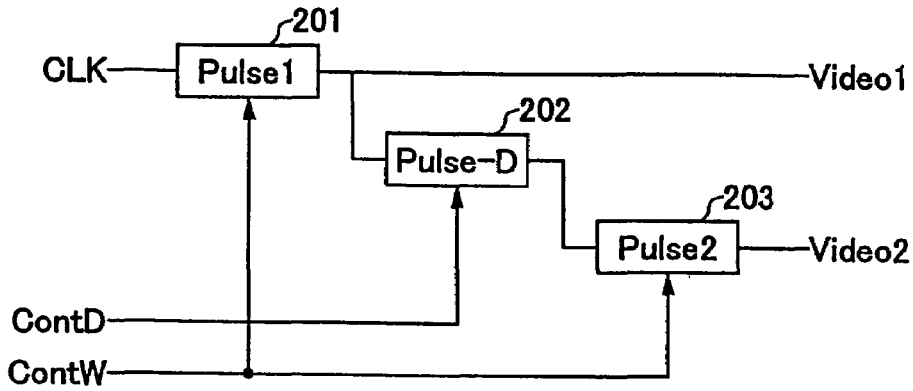
FIG. 23 is a system block diagram showing a structure of a circuit for generating the first pattern A shown in FIG. 21A.
Figure 24A:
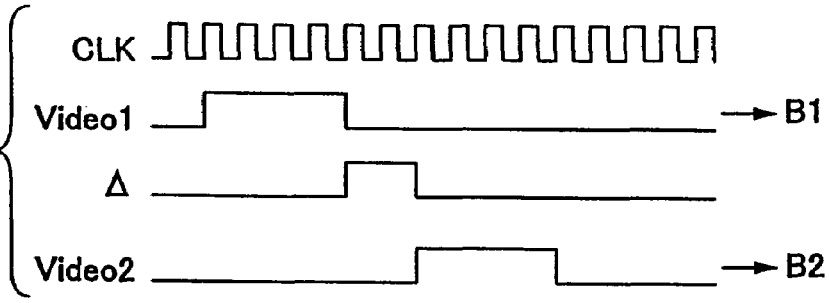
FIGS. 24A and 24B are timing charts for explaining an operation of the circuit shown in FIG. 23.
Figure 24B:
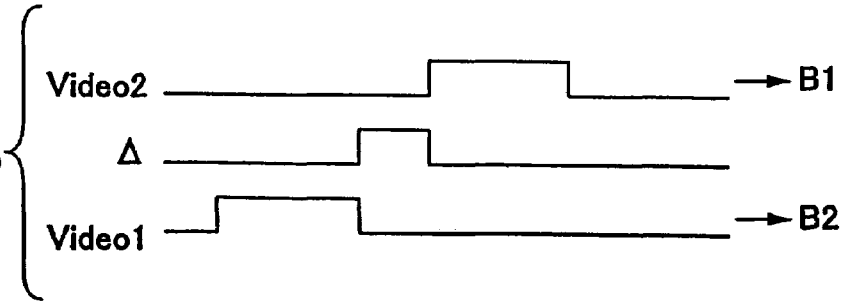

FIG. 23 is a system block diagram showing a structure of a circuit for generating the first pattern A shown in FIG. 21A. FIGS. 24A and 24B are timing charts for explaining an operation of the circuit shown in FIG. 23.

The circuit shown in FIG. 23 includes a pulse generating circuit (Pulse1) 201, a pulse delay circuit (Pulse-D) 202, and a pulse generating circuit (Pulse2) 203. The pulse generating circuit 201 generates a pulse signal Video1 corresponding to the light beam B1 in response to a clock signal CLK, as shown in FIG. 24A. The pulse delay circuit 202 is triggered in response to a falling edge of the pulse signal Video1, and outputs a pulse signal Δ only during a predetermined time Δ. The pulse generating circuit 203 generates a pulse signal Video2 corresponding to the light beam B2 in response to the pulse signal Δ, as shown in FIG. 24A.

A pulse width of the pulse signal is adjustable by a control signal ContD which is supplied to the pulse delay circuit 202, and a pulse width of the pulse signal Video2 is adjustable by a control signal ContW which is supplied to the pulse generating circuit 203. In other words, the number of dots is adjustable by the control signal ContW, and the distance deviation Δ (interval Δ) is adjustable by the control signal ContD. Therefore, it is possible to effectively detect the phase error between the light beams by appropriately setting the control signals ContD and ContW depending on the image forming apparatus (electrophotography engine).

The second pattern B shown in FIG. 21B may be generated by a circuit similar to the circuit shown in FIG. 23. Alternatively, it is possible to use the circuit shown in FIG. 23 to generate the second pattern B, by switching the pulse signals Video1 and Video2 as shown in FIG. 24B, so that the pulse signal Video2 corresponds to the light beam B1 and the pulse signal Video1 corresponds to the light beam B2.

As will be described later, the evaluation chart, that is, the first and second pattern groups, may be generated by software. In this case, the image data used for generating the evaluation chart may be stored in a recording medium such as a floppy disk and a ROM, and read from the recording medium when necessary. Alternately, the image data used for generating the evaluation chart may be generated by the video controller 71. In this latter case, the video controller 71 may be realized by a personal computer or the like.

In a case where the image data used for generating the evaluation chart is fixed, such as the case where the image data used for generating the evaluation chart is prestored in the floppy disk, ROM or the like, it is impossible to control the number of rows of dots as described above in conjunction with FIGS. 23, 24A and 24B. For this reason, when an attempt is made to print the patterns such as those shown in FIGS. 19A and 19B at 1200 dpi, it may not be possible to obtain a sufficient tone. In this case, the bias circuit 114 shown in FIG. 1 may be adjusted to set the bias (developing bias) to a high value only when checking the phase error, so that the dots having a sufficient tone are printed.

In other words, the conditions related to the formation of the dots, such as the developing bias, need to be changeable in the case where the image data used for generating the evaluation chart is fixed, such as the case where the image data used for generating the evaluation chart is prestored in the floppy disk, ROM or the like.

Figure 25:
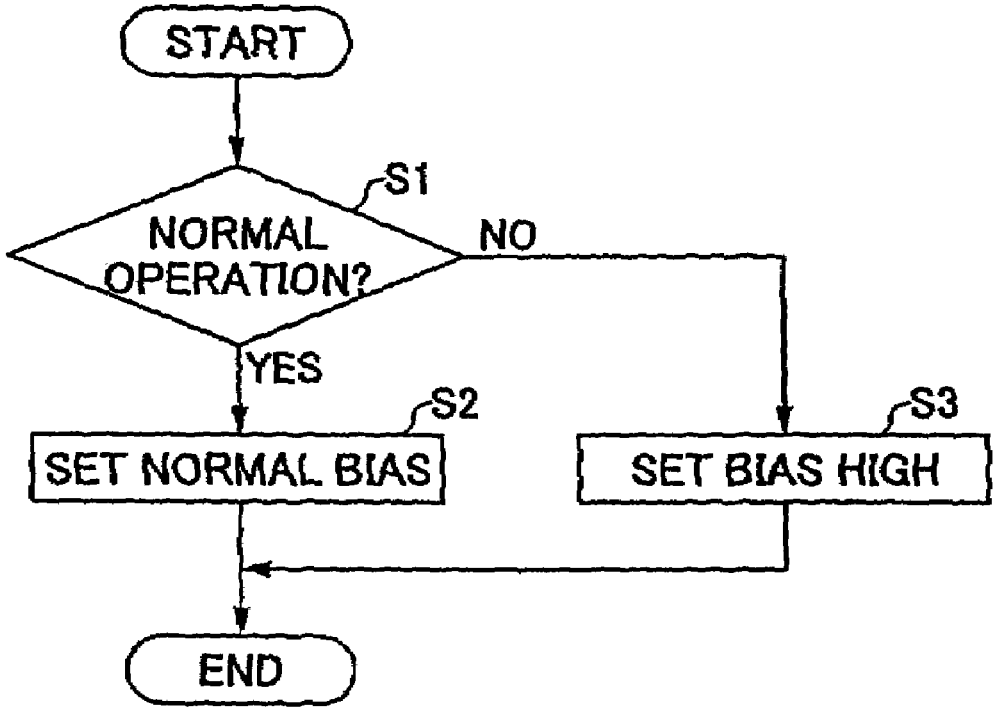
FIG. 25 is a flow chart for explaining a bias setting process.

FIG. 25 is a flow chart for explaining a bias setting process. In FIG. 25, a step S1 decides whether or not the image forming apparatus is to carry out a normal operation. If the normal operation is to be carried out and the decision result in the step S1 is YES, a step S2 sets a normal bias (standard bias), and the process ends. On the other hand, if the normal operation is not to be carried out, that is, the phase error is to be checked, and the decision result in the step S1 is NO, a step S3 sets a bias value which is higher than the normal bias (standard bias), and the process ends.

Figure 26:
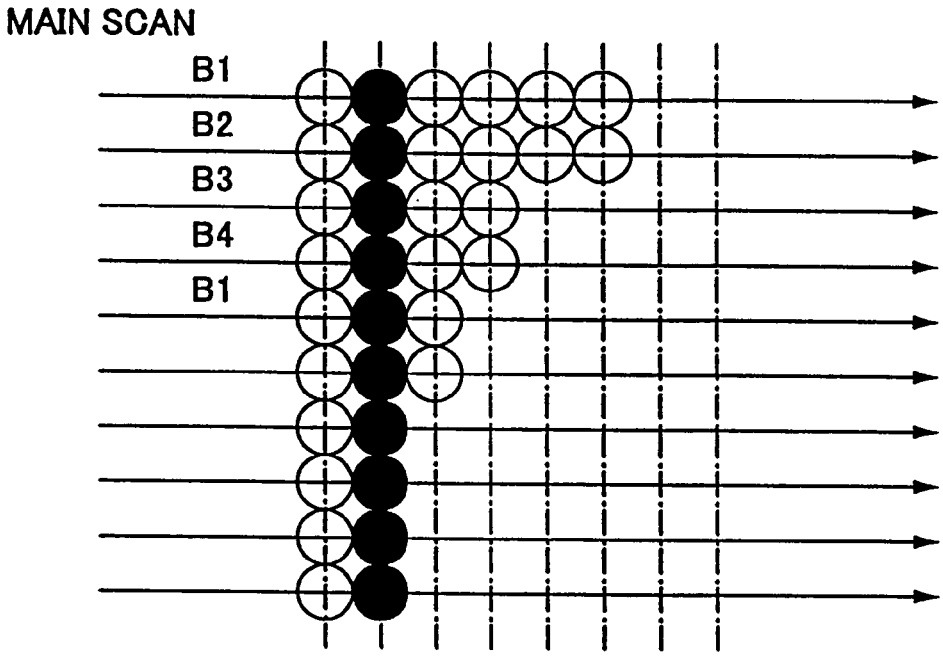
FIG. 26 is a diagram for explaining an image formation by four light beams B1, B2, B3 and B3 which are aligned without an error.

Therefore, the phase error among the light beams B1, B2, B3 and B4 can effectively be detected visually. By changing the timings of each of the light beams B1, B2, B3 and B4 manually by the operator, for example, it is possible to realize an image formation in which the four light beams B1, B2, B3 and B4 are aligned without an error. FIG. 26 is a diagram for explaining the image formation by the four light beams B1, B2, B3 and B3 which are aligned without the error.

For example, in the 4-beam optical system which emits the four light beams B1, B2, B3 and B4, the light beams B1 and B2 are adjusted, the light beams B2 and B3 are then adjusted, and the light beams B3 and B4 are thereafter adjusted. Finally the adjustment ends after confirming that there is no phase error between the light beams B4 and B1.

Figure 27:
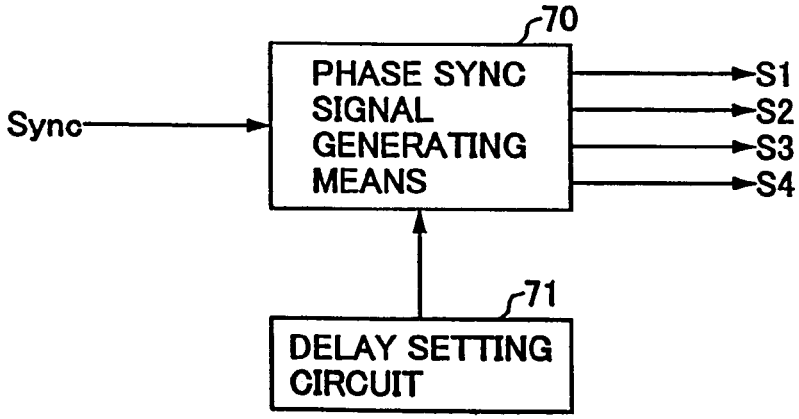
FIG. 27 is a system block diagram showing a circuit for generating horizontal synchronizing signals S1, S2, S3 and S4 which are used to synchronize the phases of the light beams B1, B2, B3 and B4 when an optical system of the four light beams B1, B2, B3 and B4 is used.

FIG. 27 is a system block diagram showing a circuit for generating phase synchronizing signals (hereinafter referred to as horizontal synchronizing signals) S1, S2, S3 and S4 which are used to synchronize the phases of the light beams B1, B2, B3 and B4 when the 4-beam optical system which emits the four light beams B1, B2, B3 and B4 is used. The circuit shown in FIG. 27 includes the phase synchronizing signal generating means 70 which forms a phase synchronizing signal generating means, and a delay setting circuit 71 which forms a phase correction amount setting means. The delay setting circuit 71 sets a phase correcting amount in the main scan direction with respect to each of the light beams B1, B2, B3 and B4. Based on the phase correcting amounts set by the delay setting circuit 71, the phase synchronizing signal generating means 70 generates the horizontal synchronizing signals S1, S2, S3 and S4 with respect to the light beams B1, B2, B3 and B4.

Accordingly, when the light beams B1, B2, B3 and B4 pass the horizontal synchronizing sensor 69, the light beam B1 (semiconductor laser 85) is turned ON and the light beams B2, B3 and B4 (semiconductor lasers 86, 87 and 88) are turned OFF. In addition, the phase synchronizing signal generating means 70 generates the horizontal synchronizing signals S1, S2, S3 and S4 respectively corresponding to the light beams B1, B2, B3 and B4 based on a signal Sync which is output from the horizontal synchronizing sensor 69 when the light beam B1 is detected thereby. The image data is printed in synchronism with the horizontal synchronizing signals S1, S2, S3 and S4.

Figure 28:
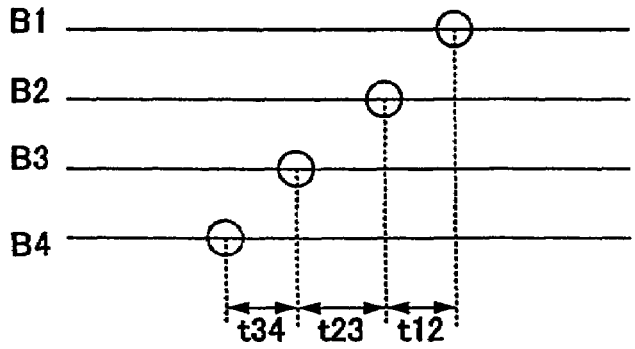
FIG. 28 is a diagram for explaining a case where the phase error of the light beams exists.
Figure 29:
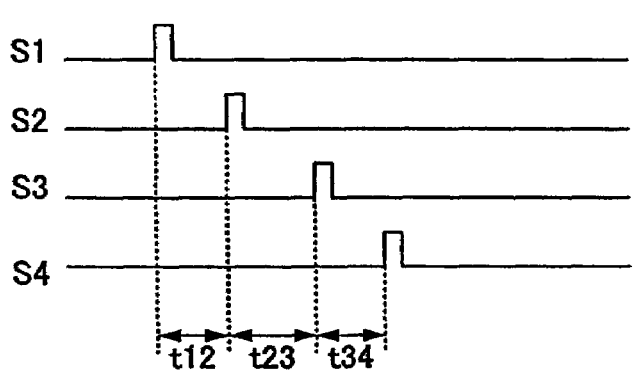
FIG. 29 is a timing chart for explaining an adjustment of time intervals t12, t23, and t34 of the horizontal synchronizing signals S1, S2, S3 and S4.

As described above, it is possible to determine whether or not a phase error exists among the light beams B1, B2, B3 and B4 by visually checking the evaluation chart having the first pattern groups P12*a*, P23*a*, P34*a* and P41*a* and the second pattern groups P12*b*, P23*b*, P34*b* and P41*b* as shown in FIG. 9 or 14. If the phase error exists, the operator sets the phase correcting amount in the delay setting circuit 71 shown in FIG. 27, so as to correct the generation timings of the horizontal synchronizing signals S1, S2, S3 and S4, that is, to correct the phase error. For example, in a case where a phase error exists among the light beams B1, B2, B3 and B4 as shown in FIG. 28, time intervals t12, t23 and t34 of the horizontal synchronizing signals S1, S2, S3 and S4 are adjusted as shown in FIG. 29 to change the print timings of the dots in the main scan direction, so that the phase error among the light beams B1, B2, B3 and B4 is corrected. FIG. 28 is a diagram for explaining the case where the phase error of the light beams exists, and FIG. 29 is a timing chart for explaining the adjustment of the time intervals t12, t23, and t34 of the horizontal synchronizing signals S1, S2, S3 and S4.

Figure 30:
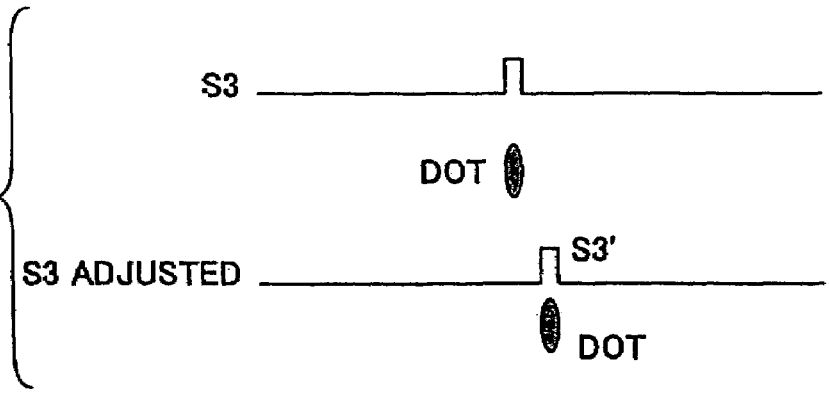
FIG. 30 is a timing chart for explaining a dot shift caused by the timing adjustment of the horizontal synchronizing signal.

FIG. 30 is a timing chart for explaining a dot shift caused by the timing adjustment of the horizontal synchronizing signal. In FIG. 30, if the timing of the horizontal synchronizing signal S3 is shifted to the right as indicated by S3', the corresponding dot generating position also shifts to the right in response to this shift. Therefore, by adjusting the timings of the horizontal synchronizing signals S1, S2, S3 and S4, it is possible to finely adjust the phases of the four light beams B1, B2, B3 and B4.

Figure 31:
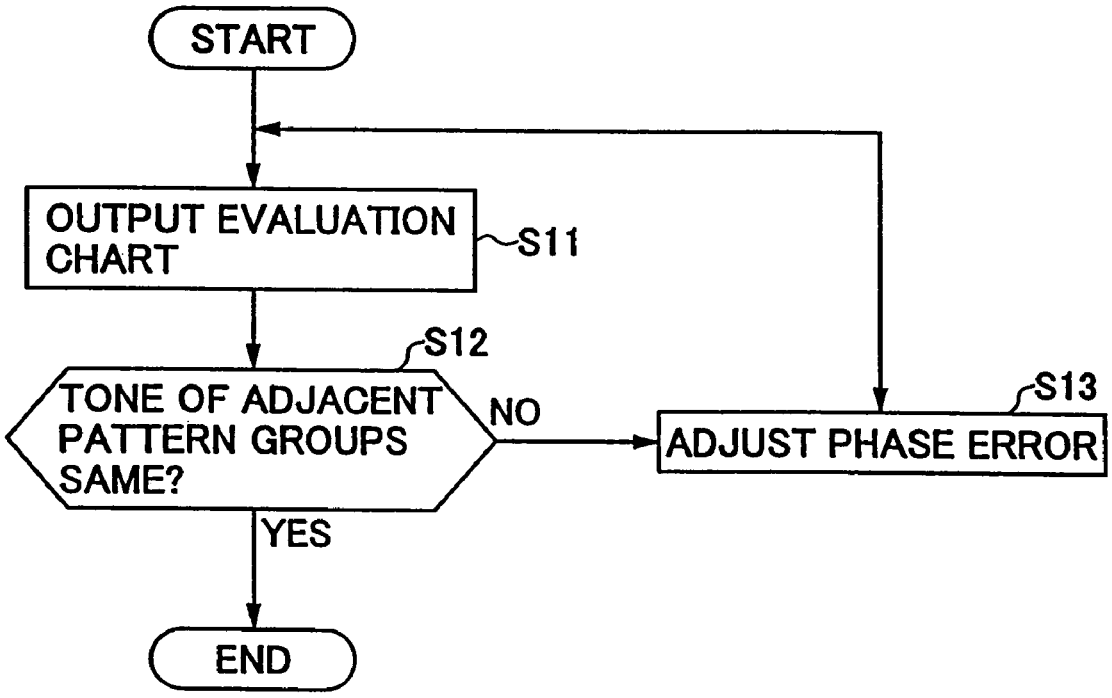
FIG. 31 is a flow chart for explaining a process of correcting the phase error of the light beams using a delay setting circuit shown in FIG. 27.

FIG. 31 is a flow chart for explaining a process of correcting the phase error of the light beams using the delay setting circuit 71 shown in FIG. 27. In FIG. 31, a step S11 outputs, that is, prints, the evaluation chart shown in FIG. 9 or 14 on the paper by the image forming apparatus. In a step S12, the operator visually checks the evaluation chart which is output, and decides whether or not the tones of the adjacent pattern groups are the same. If the decision result in the step S12 is NO, it is judged that a phase error exists among the light beams, and a step S13 adjusts and corrects the phase error of the light beams using the delay setting circuit 71 shown in FIG. 27. The process returns to the step S11 after the step S13, so as to output the evaluation chart with the corrected phase error. On the other hand, the process ends if the decision result in the step S12 is YES.

Figure 32:
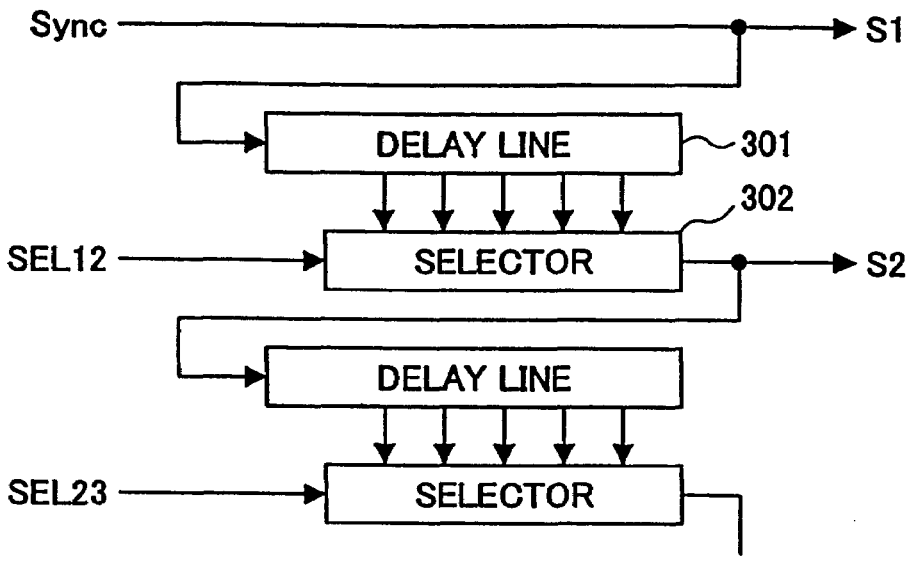
FIG. 32 is a system block diagram showing a structure of a phase synchronizing signal generating means shown in FIG. 27.

FIG. 32 is a system block diagram showing a structure of the phase synchronizing signal generating means 70 shown in FIG. 27. The phase synchronizing signal generating means 70 shown in FIG. 32 includes a plurality of delay lines and a plurality of selectors. The horizontal synchronizing signal S1 is generated from the signal Sync output from the horizontal synchronizing sensor 69. More particularly, the signal Sync is output as the horizontal synchronizing signal S1. The horizontal synchronizing signal S1 is delayed in five steps by a delay line 301. At the time of the adjustment, a selector 302 selects one of the five delayed signals from the delay line 301 in response to a selection signal SEL12, and outputs the selected delayed signal as the horizontal synchronizing signal S2. Another delay line and another selector are successively provided at a stage next to the selector 302 as shown in FIG. 32, and the illustration of the remaining part of the phase synchronizing signal generating means 70 is omitted in FIG. 32, but the horizontal synchronizing signals S3 and S4 can be generated similarly to the horizontal synchronizing signals S1 and S2.

In addition, it is possible to output an evaluation chart having a pattern group of a predetermined one of the plurality of light beams with a phase which is shifted in advance in the main scan direction, with respect to each of the first pattern group and the second pattern group described above. By outputting such an evaluation chart, it becomes possible to simply obtain a phase correcting amount for correcting the phase error among the light beams.

FIGS. 33A, 33B, 34A, 34B, 35A and 35B are diagrams for explaining the first pattern A and the second pattern B for a case where the phase of the light beam B2 in the main scan direction is shifted in advance.

Figures 33A, 33B:
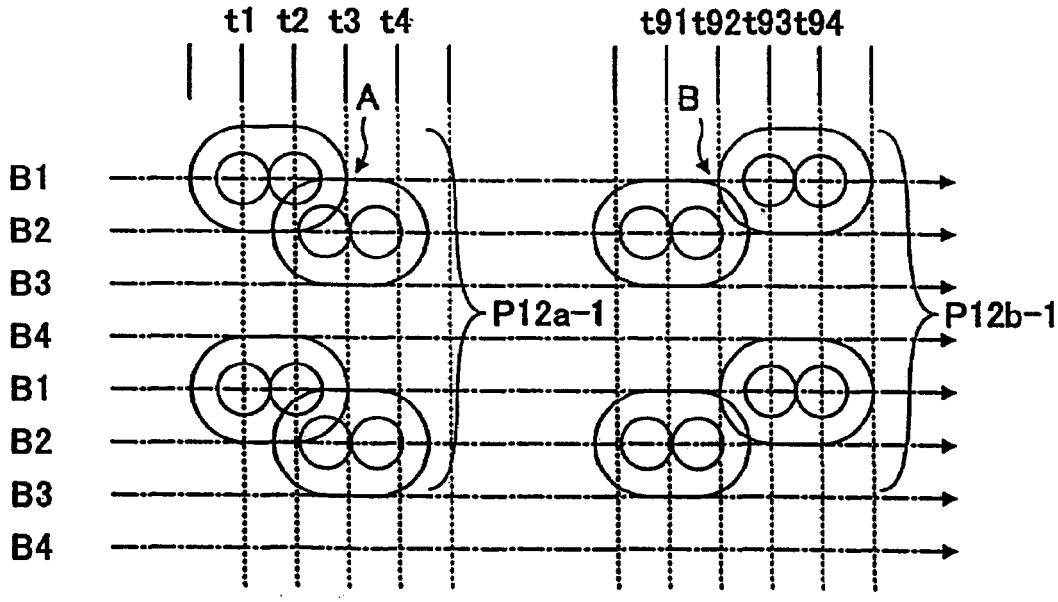
FIGS. 33A and 33B are diagrams for explaining the first pattern A and the second pattern B for a case where the phase of the light beam B2 in the main scan direction is shifted in advance.
Figures 34A, 34B:
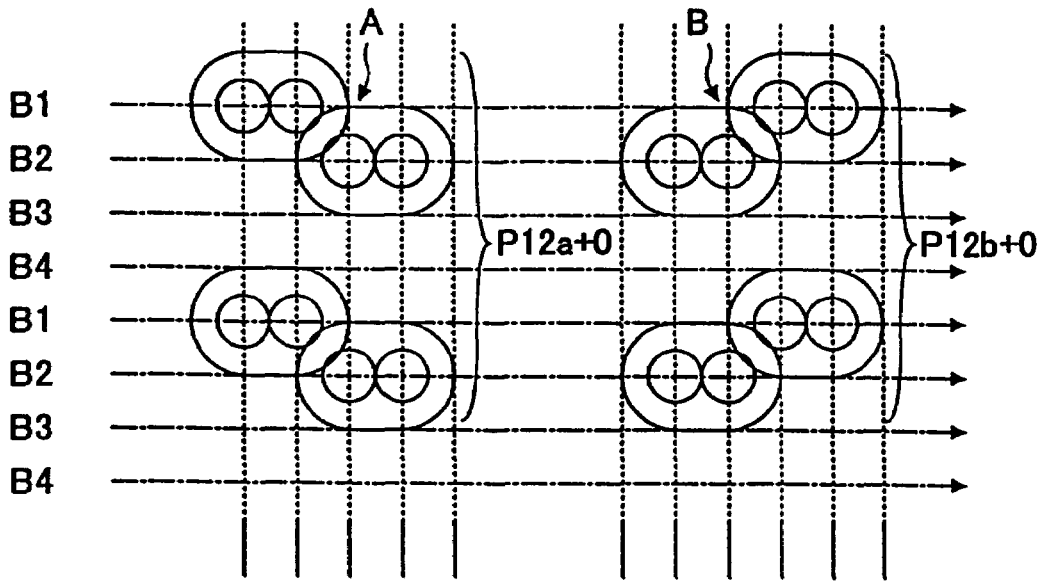
FIGS. 34A and 34B are diagrams for explaining the first pattern A and the second pattern B for the case where the phase of the light beam B2 in the main scan direction is shifted in advance.
Figures 35A, 35B:
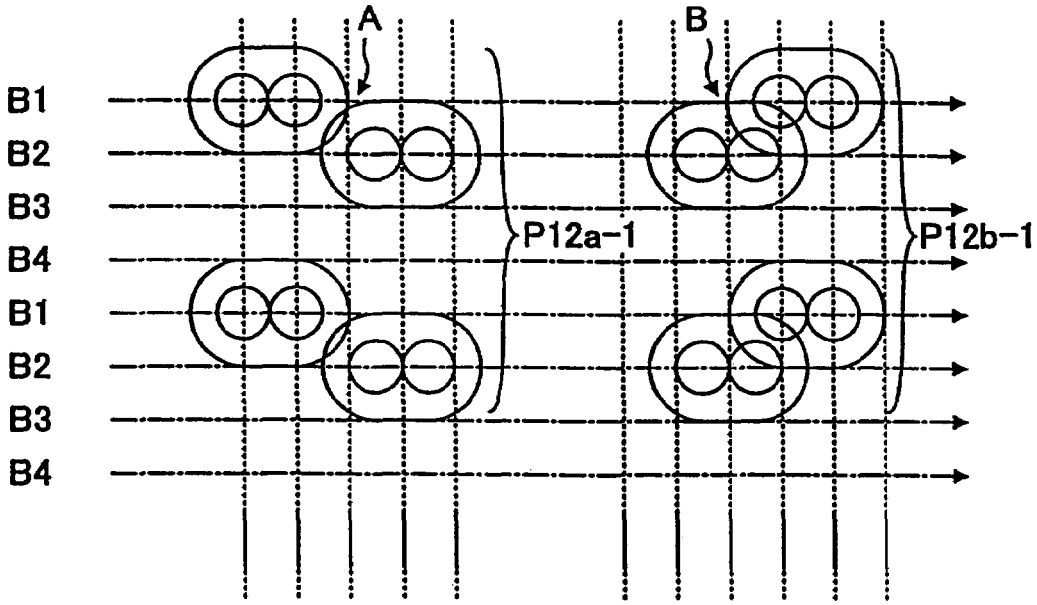
FIGS. 35A and 35B are diagrams for explaining the first pattern A and the second pattern B for the case where the phase of the light beam B2 in the main scan direction is shifted in advance.

FIGS. 33A and 33B respectively show the first pattern A and the second pattern B for a case where the phase of the light beam B2 in the main scan direction is shifted in advance to the left. FIGS. 34A and 34B respectively show the first pattern A and the second pattern B for a case where the phase of the light beam B2 in the main scan direction is not shifted in advance. FIGS. 35A and 35B respectively show the first pattern A and the second pattern B for a case where the phase of the light beam B2 in the main scan direction is shifted in advance to the right.

Figure 36:
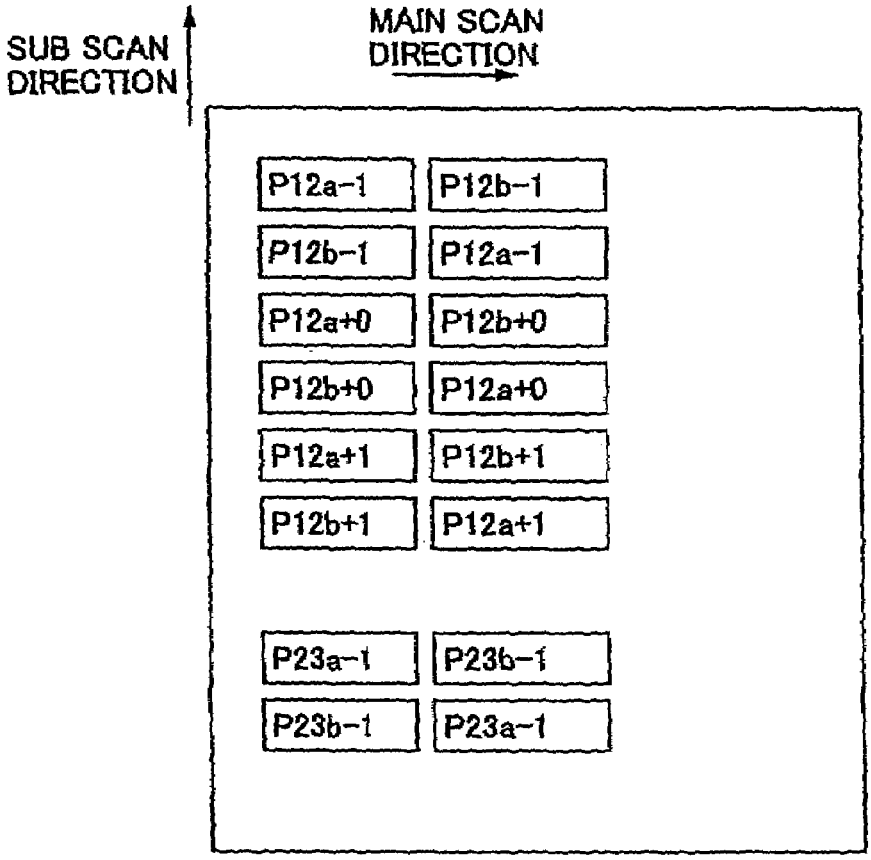
FIG. 36 is a diagram showing another evaluation chart used in the second embodiment.

Pattern groups formed by the first pattern A and the second pattern B shown in FIGS. 33A and 33B will be referred to as pattern groups P12*a*−1 and P12*b*−1. Pattern groups formed by the first pattern A and the second pattern B shown in FIGS. 34A and 34B will be referred to as pattern groups P12*a*+0 and P12*b*+0. Pattern groups formed by the first pattern A and the second pattern B shown in FIGS. 35A and 35B will be referred to as pattern groups P12*a*+1 and P12*b*+1. FIG. 36 is a diagram showing another evaluation chart used in this second embodiment, where the pattern groups P12*a*−1, P12*b*−1, P12*a*+0, P12*b*+0, P12*a*+1 and P12*b*+1 are arranged in the manner shown. The phase correcting amount for correcting the phase error among the light beams can simply be obtained by use of this evaluation chart. For example, if the light beam B2 is actually shifted by +1 with respect to the light beam B1, for example, the tone difference between the pattern groups P12*a*−1 and P12*b*−1 is eliminated by printing the pattern groups P12*a*−1 and P12*b*−1 which are shifted by −1 in advance. In this case, the phase correcting amount can simply be obtained as being −1.

In the particular cases described above, the shifts of −1, 0 and +1, that is, three shifting steps, are employed for the sake of convenience. However, the number of shifting steps may of course be greater than three. For example, it is possible to form the patterns by employing eight steps in the negative direction (left shift), eight steps in the positive direction (right shift) and a zero shift, that is, by employing a total of seventeen shifting steps.

When the evaluation chart shown in FIG. 36 is output, the phase correcting amount can be obtained by visually checking the evaluation chart, and the phase error (phase synchronization error) of the light beams can be adjusted and corrected manually by the operator.

Figure 37:
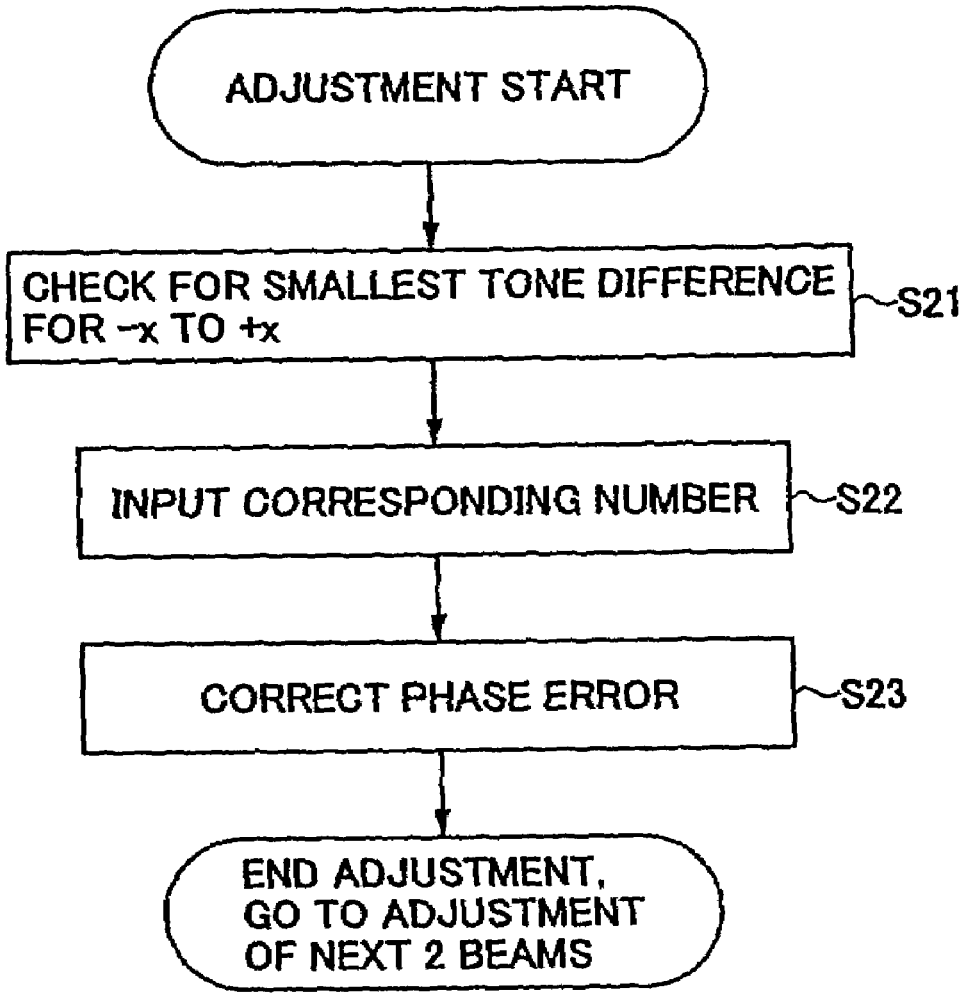
FIG. 37 is a flow chart for explaining a process of manually adjusting a phase error.

FIG. 37 is a flow chart for explaining a process of manually adjusting the phase error. In a step S21 shown in FIG. 37, the operator compares the pattern group pairs P12*a*−x and P12*b*−x, . . . , P12*a*+x and P12*b*+x of two light beams such as the light beams B1 and B2, for example, and checks which of the pattern group pairs from −x to +x has the smallest tone difference. In a step S22, the operator inputs from the operation panel 74 a number corresponding to the shifting step having the smallest tone difference. For example, if the smallest tone difference is detected for the shifting step −1, a number corresponding to this shifting step is input from the operation panel 74. The phase correcting amounts, that is, adjusting values, are prestored in a non-volatile memory such as a ROM 73 within the video controller 71 shown in FIG. 2. When the number corresponding to the shifting step −1 is input from the operation panel 74, the phase correcting amount (adjusting value) corresponding to this input number is read from the ROM 73 and supplied to the delay setting circuit 71 shown in FIG. 27. Hence, a step S23 corrects the phase error between the two light beams, namely, the light beams B1 and B2 in this particular case, using the read phase correcting amount (adjusting value). After the step S23, operations and processes similar to those described above with respect to the light beams B1 and B2 are carried out with respect to each of the other two light beams to correct the phase error.

Therefore, after the evaluation chart is output, the operator visually detects the tone difference of the patterns, and adjusts and corrects the phase error by making the manual input from the operation panel 74. However, the image forming apparatus may be constructed to automatically adjust or correct the phase error.

Figure 38:
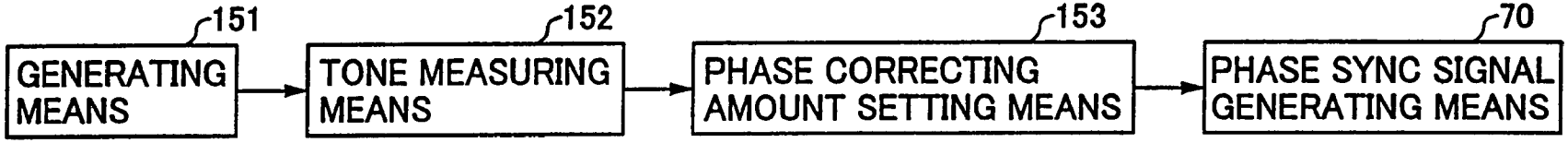
FIG. 38 is a system block diagram showing a structure of an image forming apparatus which is provided with a function of automatically correcting or adjusting the phase error.

FIG. 38 is a system block diagram showing a structure of an image forming apparatus which is provided with a function of automatically correcting or adjusting the phase error. The image forming apparatus shown in FIG. 38 includes a generating means 151, a tone measuring means 152, a phase correcting amount setting means 153, and the phase synchronizing signal generating means 70. With respect to each of the first pattern group and the second pattern group, the generating means 151 generates on the photoconductive body 66 the pattern group of a predetermined one of the plurality of light beams having the phase in the main scan direction shifted in advance. The tone measuring means 152 measures the tone of the pattern group on the photoconductive body 66. Based on the tone measured by the tone measuring means 152, the phase correcting amount setting means 153 sets the phase correcting amount in the main scan direction. The phase synchronizing signal generating means 70 generates the horizontal synchronizing signals (phase synchronizing signals) of the light beams based on the phase correcting amount set by the phase correcting amount setting means 153. The tone measuring means 152 may be realized by a tone sensor, for example. Further, the phase correcting amount setting means 153 may be realize by the delay setting circuit 71 shown in FIG. 27, for example.

Figure 39:
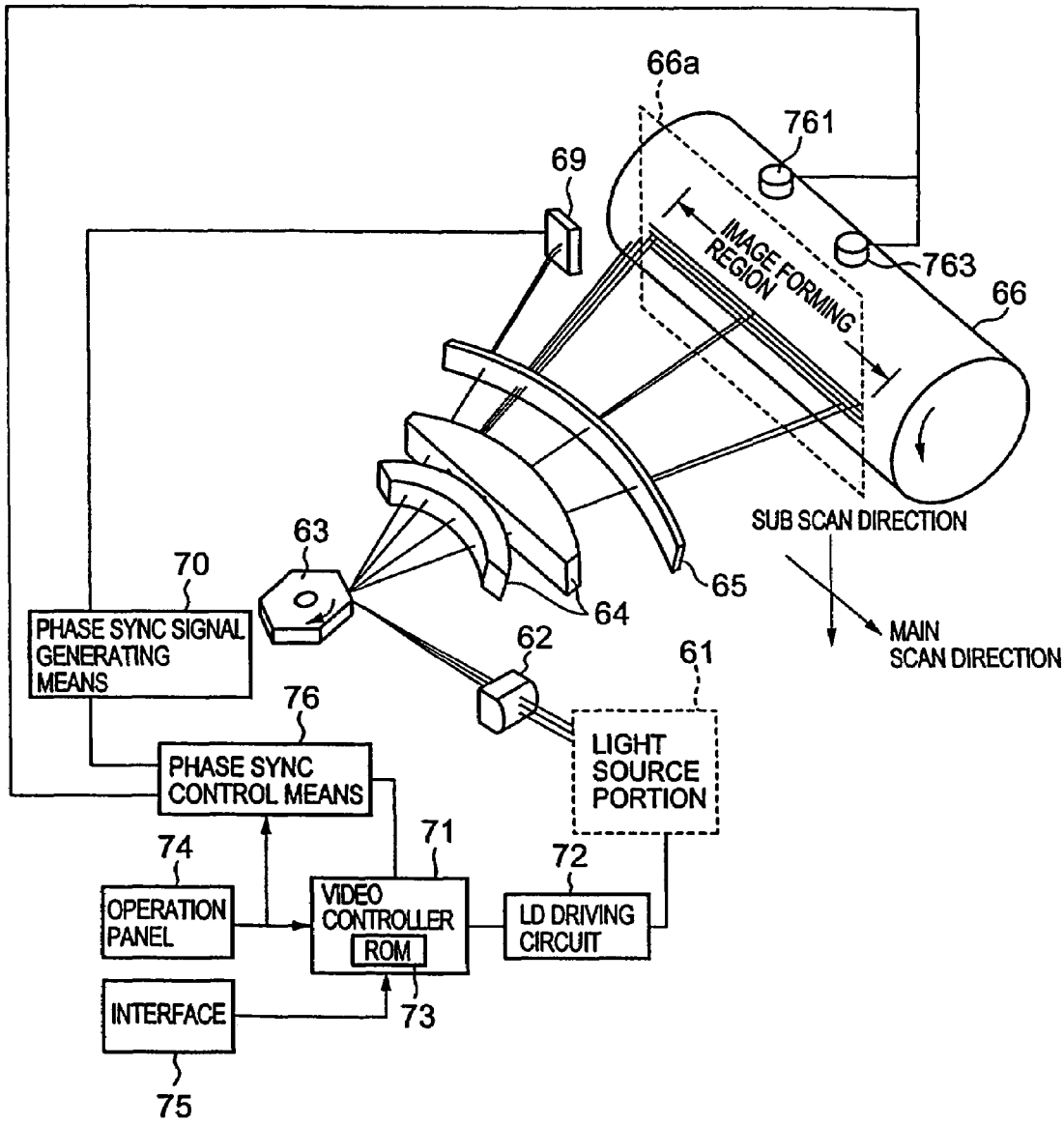
FIG. 39 is a diagram for explaining setting of a tone measuring means which measures a tone of a pattern group on a photoconductive body.
Figure 40:
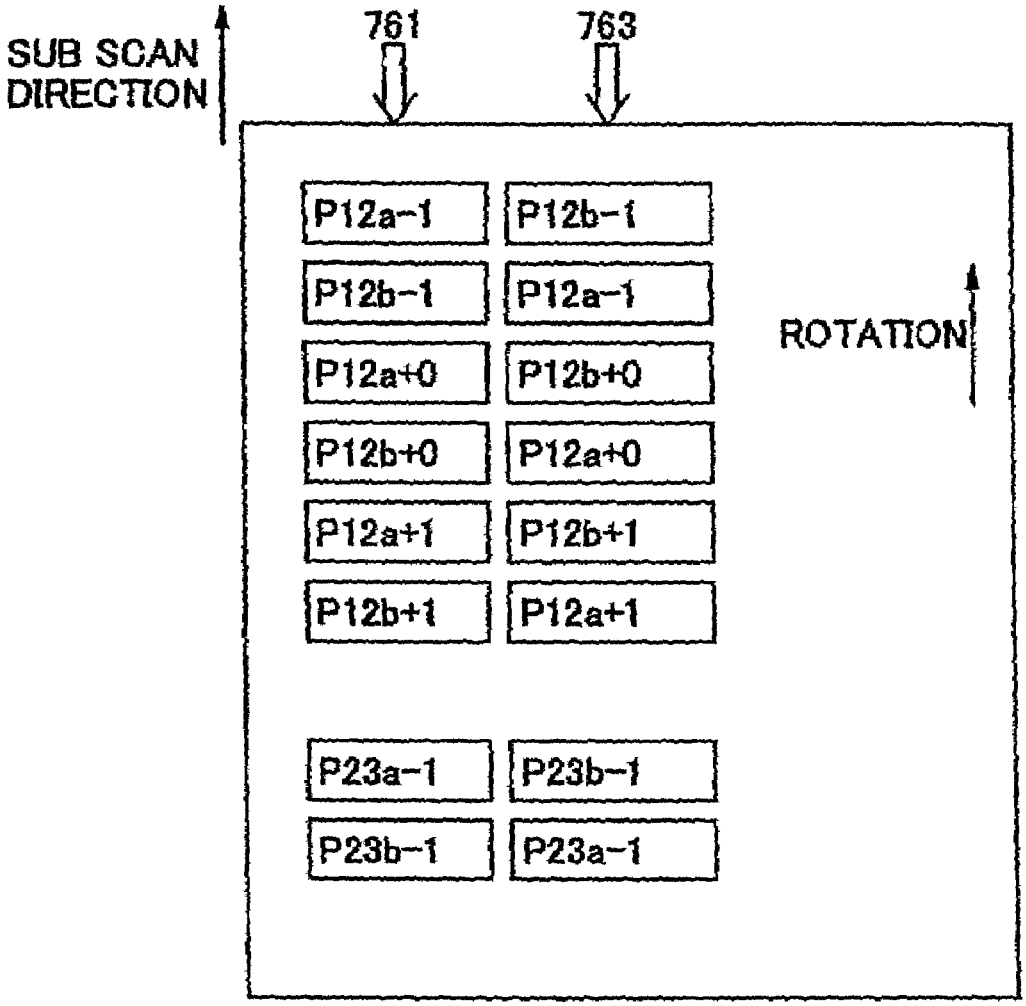
FIG. 40 is a diagram for explaining the pattern group formed on the photoconductive body.

FIG. 39 is a diagram for explaining setting of the tone measuring means 152 which measures the tone of the pattern group on the photoconductive body 66. In FIG. 39, those parts which are the same as those corresponding parts in FIG. 2 are designated by the same reference numerals, and a description thereof will be omitted. A reference numeral 76 in FIG. 39 designates a phase synchronization control means. FIG. 40 is a diagram for explaining the pattern groups formed on the photoconductive body 66. In the case shown in FIG. 39, the pattern groups shown in FIG. 40 are formed on the photoconductive body 66, and a tone sensor 761 is set to measure the tone of the left pattern groups, while a tone sensor 763 is set to measure the tone of the right pattern groups.

In the image forming apparatus shown in FIGS. 38 and 39, the tones of the pattern groups on the photoconductive body 66 are measured by the tone sensors 761 and 763. Hence, it is possible to automatically adjust or correct the phase error of the light beams without the need to actually print the image of the evaluation chart on the paper.

Figure 41:
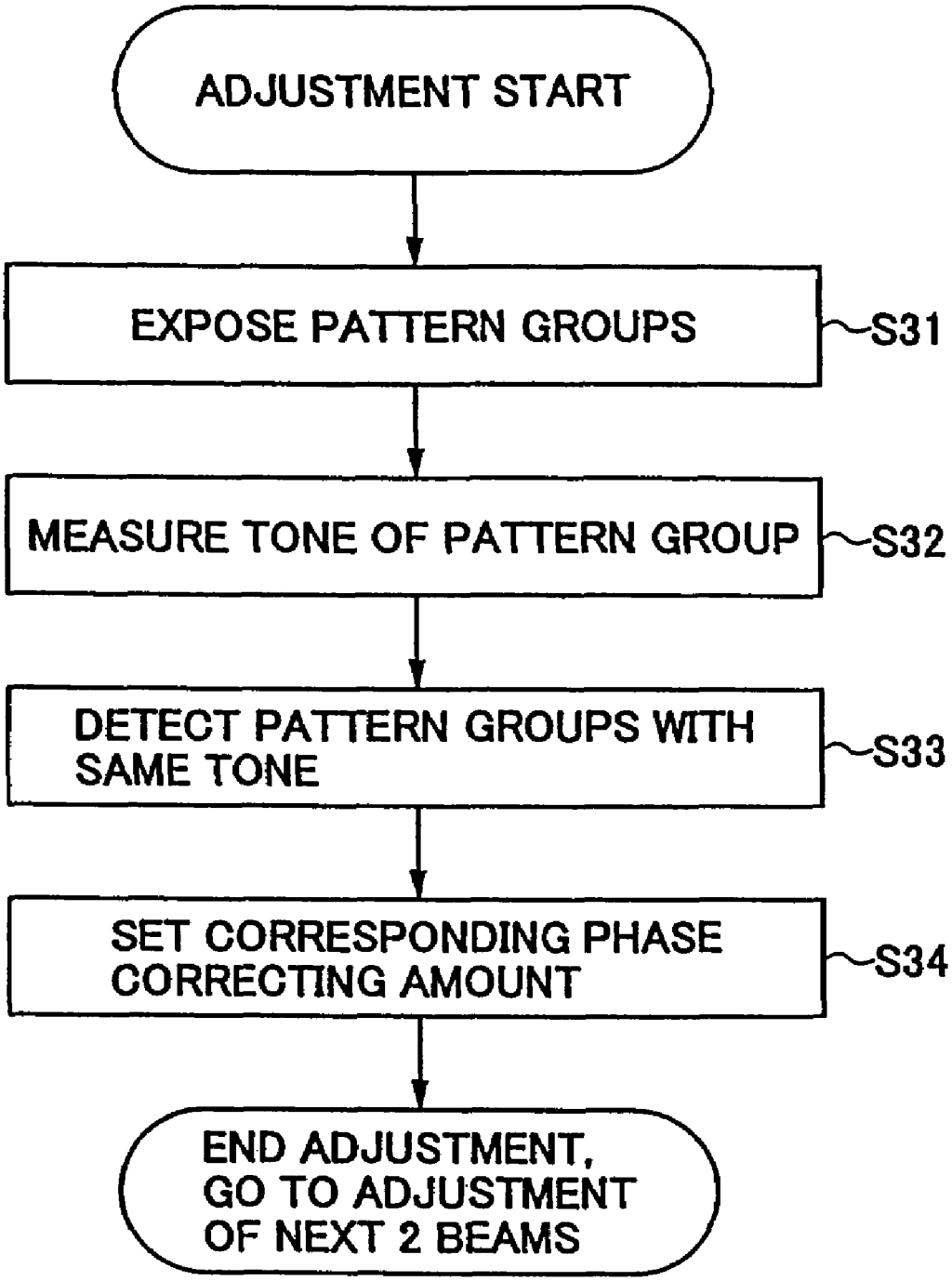
FIG. 41 is a flow chart for explaining an automatic adjusting or correcting process for adjusting or correcting the phase error of the light beams in the image forming apparatus shown in FIGS. 38 and 39.

FIG. 41 is a flow chart for explaining an automatic adjusting or correcting process for adjusting or correcting the phase error of the light beams in the image forming apparatus shown in FIGS. 38 and 39.

In FIG. 41, a step S31 exposes the pattern groups shown in FIG. 40 on the photoconductive body 66, and a step S32 measures the tones of the pattern groups formed on the photoconductive body 66 by the tone sensors 761 and 763. Then, a step S33 detects the pair of pattern groups having the same tone. In other words, of the pattern groups shown in FIG. 40, the tones of the left pattern groups are measured by the tone sensor 761, the tones of the right pattern groups are measured by the tone sensor 763, and a decision is made to determine whether the tone of one of the left pattern groups matches the tone of one of the right pattern groups, so as to detect the pair of left and right pattern groups having the same tone. For example, with respect to the light beams B1 and B2, the pair of pattern groups P12*a*+1 and P12*b*+1 are detected as having the same tone. When the pair of pattern groups P12*a*+1 and P12*b*+1 are detected as having the same tone, a step S34 sets the corresponding phase correcting amount −1 in the delay setting circuit 71. In other words, since the light beam B2 is shifted by +1 with respect to the light beam B1, the correcting amount −1 is set. As a result, the phase synchronizing signal generating means 70 automatically corrects the phase error between the two light beams B1 and B2. The phase synchronizing signal generating means 70 automatically corrects the phase error between the next two light beams B2 and B2 in a similar manner, and the phase error between two light beams can be corrected automatically for the other light beams.

According to the image forming apparatus shown in FIGS. 38 and 39, it is possible to detect the phase error between the light beams within the image forming region in a simple manner and with a high sensitivity. In addition, the phase error of the light beams can be corrected automatically, thereby requiring no manual correcting operation. As a result, it is possible to reduce the burden on the operator, including service or maintenance personnel and users.

Figure 42:
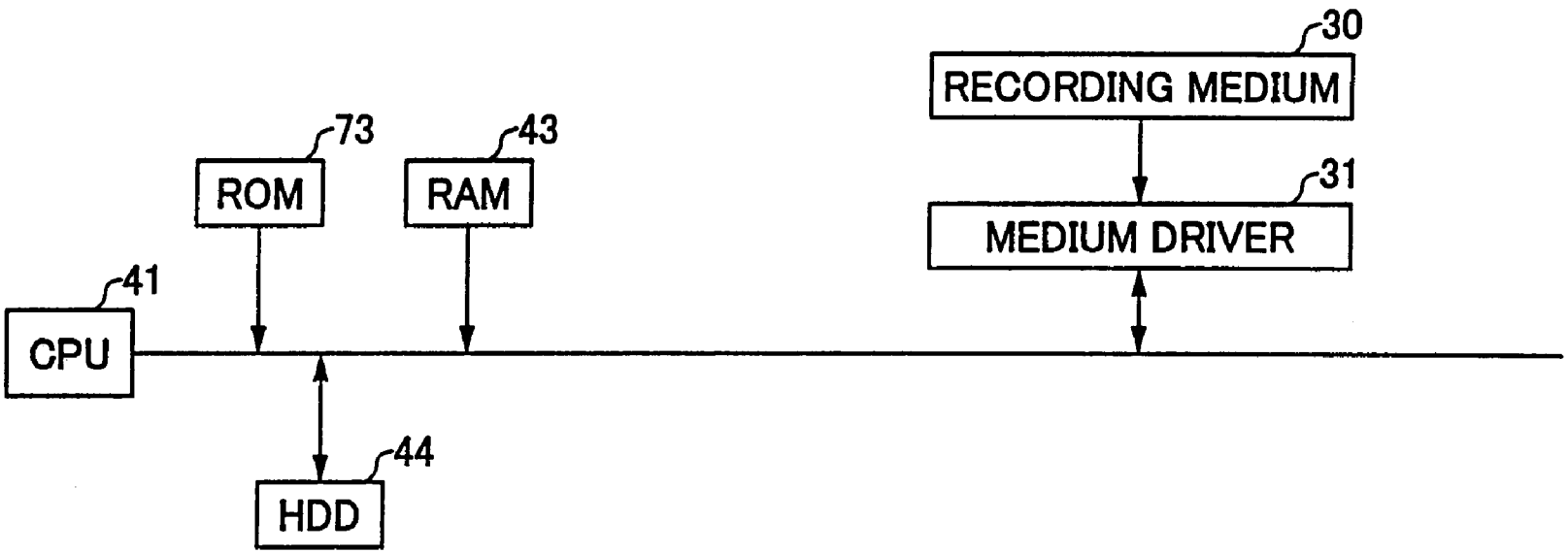
FIG. 42 is a system block diagram showing a hardware structure of a video controller.

The video controller 71 of the image forming apparatus according to the present invention may be formed by an electronic circuit or, by a personal computer or the like. FIG. 42 is a system block diagram showing a hardware structure of the video controller 71 within the image forming apparatus. The image forming apparatus is formed by a personal computer or the like in the case shown in FIG. 42, and the video controller 71 includes a CPU 41, a ROM 73, a RAM 43, and a hard disk drive (HDD) 44 including at least one hard disk. The CPU 41 controls the general operation of the image forming apparatus. The ROM 73 stores control programs and the like to be executed by the CPU 41. The RAM 43 is used as a work area for the CPU 41. The hard disk drive 44 is used to store various data, and may also be used as the work area for the CPU 41.

The CPU 41 includes a function of carrying out the process of the image forming apparatus according to the present invention described above. More particularly, the CPU 41 includes the function of carrying out the process to output the evaluation chart which includes first patterns and second patterns. In the first pattern, with respect to a row of dots formed in the main scan direction by one predetermined light beam, a row of dots formed by the next one light beam is shifted in the main scan direction. In the second pattern, with respect to the row of dots formed in the main scan direction by one predetermined light beam, a row of dots formed by the next one light beam is shifted in the main scan direction but in a direction opposite to the shift direction of the first pattern. The evaluation chart actually includes a first pattern group which is formed by the first patterns which are repeated in the sub scan direction with a period that is an integer multiple of the number of light beams and are also repeated in the main scan direction at predetermined intervals, and a second pattern group which is formed by the second patterns which are repeated in the sub scan direction with a period that is an integer multiple of the number of light beams and are also repeated in the main scan direction at predetermined intervals.

Alternatively, the CPU 41 includes the function of carrying out the process to output the evaluation chart which includes first patterns and second patterns. In the first pattern, with respect to the row of dots formed in the main scan direction by one predetermined light beam, the row of dots formed by the next one light beam is shifted in the main scan direction. In the second pattern, with respect to the row of dots formed in the main scan direction by one predetermined light beam, the row of dots formed by the next one light beam is shifted in the main scan direction but in a direction opposite to the shift direction of the first pattern. The evaluation chart actually includes a first pattern group which is formed by the first patterns which are repeated in the sub scan direction with a period that is an integer multiple of the number of light beams, and a second pattern group which is formed by the second patterns which are repeated in the sub scan direction with a period that is an integer multiple of the number of light beams.

The above described function of the CPU 41 may be provided in the form of a software package, by a recording medium such as a CD-ROM. Hence, in the case shown in FIG. 42, a medium driver 31 is provided to drive a recording medium 30 when the recording medium 30 is set in the image forming apparatus. This recording medium 30, which may be any kind of recording media capable of storing a computer program, forms a computer-readable storage medium according to the present invention.

Therefore, the video controller 71 or, the image forming apparatus which includes the video controller 71, may be realized by a microprocessor of a general purpose computer system which executes a computer program for causing the computer system to carry out the above described process of the image forming apparatus according to the present invention. This computer program may be stored in the recording medium 30 such as the CD-ROM, and in this case, the computer program read from the recording medium 30 is installed into the computer system by being written into the hard disk of the hard disk drive 44, for example.

As described above, the recording medium 30 which stores the computer program may be formed by any kind of recording media capable of storing the computer program, such as ROM, RAM, flexible disk, memory card, optical disk and magneto-optical disk, and is not limited to the CD-ROM. In addition, a storage unit of the computer system to which the installed computer program is written is of course not limited to the hard disk.

Further, the present invention is not limited to these embodiments, but various variations and modifications may be made without departing from the scope of the present invention.

What is claimed is:

1. An image forming method comprising the steps of:

(a) generating, on an image forming surface of a photoconductive body, an evaluation chart having a pattern group formed by one of a plurality of light beams with a phase which is shifted in advance in a main scan direction, with respect to each of a first pattern group and a second pattern group;

(b) measuring a tone of the pattern group in the evaluation chart; and (c) setting a phase correcting amount in the main scan direction, based on the tone measured by said step (b), wherein:

in each first pattern forming said first pattern group, with respect to a row of dots formed in the main scan direction by a predetermined light beam, a row of dots formed by a next light beam is shifted in the main scan direction, and in each second pattern forming said second pattern group, with respect to a row of dots formed in the main scan direction by the predetermined light beam, the row of dots formed by the next light beam is shifted in the main scan direction but in a direction opposite to a shift direction of said first pattern group.

2. The image forming method as claimed in claim 1, further comprising:

generating phase synchronizing signals of the plurality of light beams, based on the phase correcting amount set by said step (c).

3. The image forming method as claimed in claim 2, further comprising the steps of:

(d) variably controlling conditions related to generating the dots by said step (a) when forming the evaluation chart.

4. The image forming method as claimed in claim 1, wherein said evaluation chart includes the first pattern group formed by the first patterns which are repeated in a sub scan direction with a period that is an integer multiple of a total number of the plurality of light beams and are also repeated in the main scan direction at predetermined intervals, and the second pattern group formed by the second patterns which are repeated in the sub scan direction with a period that is an integer multiple of the total number of the plurality of light beams and are also repeated in the main scan direction at predetermined intervals.

5. The image forming method as claimed in claim 4, wherein corresponding first and second pattern groups are arranged adjacent to each other on the evaluation chart.

6. The image forming method as claimed in claim 4, wherein each first pattern group has a corresponding second pattern group arranged adjacent thereto in both the main scan direction and the sub scan direction.

7. The image forming method as claimed in claim 1, further comprising the steps of:

(d) variably controlling conditions related to generating the dots by said step (a) when forming the evaluation chart.

* * * * *